United States Patent [19]

Momoki et al.

[11] Patent Number: 4,945,038

[45] Date of Patent: Jul. 31, 1990

[54] SILVER HALIDE COLOR PHOTOGRAPHIC MATERIAL

[75] Inventors: Yasuhito Momoki; Takanori Hioki; Masaki Okazaki, all of Kanagawa, Japan

[73] Assignee: Fuji Photo Film Co., Ltd., Kanagawa, Japan

[21] Appl. No.: 310,104

[22] Filed: Feb. 14, 1989

Related U.S. Application Data

[63] Continuation-in-part of Ser. No. 138,185, Dec. 28, 1987, abandoned.

[30] Foreign Application Priority Data

Dec. 25, 1986 [JP] Japan ..... 61-314422

[51] Int. Cl.[5] ..... G03C 1/28

[52] U.S. Cl. ..... 430/576; 430/581; 430/584; 430/600

[58] Field of Search ..... 430/573, 575, 576, 578, 430/584, 600, 603, 599, 570, 607, 613, 614, 581, 522, 572

[56] References Cited

U.S. PATENT DOCUMENTS

| | | | |
|---|---|---|---|
| 3,615,632 | 10/1971 | Shiba et al. | 430/572 |
| 4,536,473 | 8/1985 | Mihara | 430/575 |
| 4,596,767 | 6/1986 | Mihara et al. | 430/576 |
| 4,618,570 | 10/1986 | Kadowaki et al. | 430/505 |
| 4,770,961 | 9/1988 | Tanaka et al. | 430/14 |
| 4,839,265 | 6/1989 | Ohno et al. | 430/581 |

FOREIGN PATENT DOCUMENTS

| | | |
|---|---|---|
| 23520/79 | 9/1970 | Japan . |
| 1208045 | 9/1986 | Japan . |

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A silver halide color photographic material is described, comprising a support having provided thereon at least one silver halide emulsion layer, wherein said at least one silver halide emulsion layer comprises at least one compound represented by the formula (I) and at least one compound represented by the formula (II):

(I)

wherein $V_1$, $V_2$, $V_3$ and $V_4$ each represents a hydrogen atom, a halogen atom, an alkyl group, an acyl group, an acyloxy group, an alkoxycarbonyl group, a carbamoyl group, a sulfamoyl group, a carboxy group, a cyano group, a hydroxy group, an amino group, an acylamino group, an alkoxy group or an aryl group, or $V_1$ and $V_2$, or $V_3$ and $V_4$ may be bound to each other to form a benzene ring;

$R_1$ and $R_2$, which may be the same or different, each represents an alkyl group and may optionally form a salt with a metal atom or other organic compound;

$X^{\ominus}$ represents an anion; and l represents 0 or 1 or, when the dye forms an inner salt, l represents 0;

(II)

wherein

D represents a divalent aromatic moiety;

$R_3$, $R_4$, $R_5$ and $R_6$ each represents a hydrogen atom, a hydroxy group, an alkoxy group, an aryloxy group, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group;

$Y_1$ and $Y_2$ each represents —N= or —CH=; and $Z_1$ and $Z_2$ each represents —N= or —CH=;

further at least one of $Y_1$ and $Z_1$ is —N=, and at least one of $Y_2$ and $Z_2$ is —N=.

11 Claims, No Drawings

SILVER HALIDE COLOR PHOTOGRAPHIC MATERIAL

FIELD OF THE INVENTION

This invention relates to a silver halide color photographic material and, more particularly, to a silver halide color photographic material having a high sensitivity and an excellent shelf life.

BACKGROUND OF THE INVENTION

Spectral sensitizing techniques are extremely important and necessary in preparing silver halide color photographic materials with high sensitivity and excellent color reproducibility. Various spectral sensitizing agents have conventionally been developed so as to provide high speed silver halide color photographic materials, and many techniques have been made as to their use such as supersensitizing processes, manner of adding the agents, etc.

It is known to use, as spectral sensitizing dyes for use in spectral sensitization, spectral sensitizing agents such as cyanine dyes, merocyanine dyes or complex merocyanine dyes alone or in combination (for example, for supersensitization).

Sensitizing dyes to be used in photographic materials must satisfy many requirements in addition to giving high spectral sensitivity. For example, they must not increase fog, must show good properties upon exposure (for example, latent image stability, reciprocity law properties, less dependence on temperature and humidity upon exposure, etc.), must undergo minimum change in sensitivity, gradation, and fog in shelf life and must not remain a developing solution in light-sensitive materials after development processing to avoid deterioration of white background. Sensitizing dyes for imparting red sensitivity also must meet the same requirements. However, these red-sensitizing dyes can cause serious defects for color light-sensitive materials of reduction in spectral sensitivity due to desorption of the dyes and so-called color mixing as a result of layer-to-layer transfer of desorbed sensitizing dyes, since the red-sensitizing dyes generally have a weak adsorbing power. These defects have been serious problems in practical use.

As for supersensitization, "supersensitization" is described in, for example, *Photographic Science and Engineering*, Vol. 13, pp. 13–17 (1969), ibid., Vol. 18, pp. 418–430 (1974), James, *The Theory of the Photographic Process*, 4th Ed., p. 259 (Macmillan, 1977) U.S. Pat. Nos. 3,743,510, 3,615,637, 3,674,499, 2,933,390, 2,937,039, 3,615,641, 3,635,721, 3,615,613, 3,617,295, 3,615,632, 3,649,288, 3,887,380, etc., and it is known that high sensitivity can be obtained by selecting a proper combination of a sensitizing dye and a supersensitizing agent.

However, conventional combinations of a red-sensitizing dye and a supersensitizing agent for enhancing sensitivity so as to satisfy the aforesaid requirements for light-sensitive materials seriously decrease sensitivity of light-sensitive materials particularly in shelf life, thus failing to provide sufficient properties. Although U.S. Pat. No. 3,615,632 discloses the combination of meso-substituted carbocyanine and a supersensitizing agent, the cross-linking type oxathiamethinecyanine of the present invention is not disclosed in the concrete. Further there is no description as to the improved shelf life under the condition of high temperature and/or high humidity of the present invention, in the U.S. Pat. No. 3,615,632.

SUMMARY OF THE INVENTION

Therefore, an object of the present invention is to provide a silver halide color photographic material which has high sensitivity and which, when stored under the condition(s) of high temperature and/or high humidity, scarcely undergoes an increase in fog and undergoes less of a change in sensitivity (i.e., it is excellent in shelf life properties).

This and other objects of the present invention will become apparent from the following description thereof.

The above-described object and other objects of the present invention are attained by a silver halide color photographic material which comprises a support having provided thereon at least one silver halide emulsion layer, wherein said at least one silver halide emulsion layer comprises at least one compound represented by the formula (I) and at least one compound represented by the formula (II):

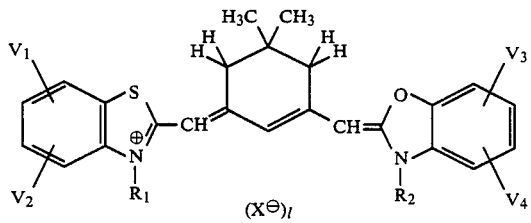

(I)

wherein $V_1$, $V_2$, $V_3$ and $V_4$ each represents a hydrogen atom, a halogen atom, an alkyl group, an acyl group, an acyloxy group, an alkoxycarbonyl group, a carbamoyl group, a sulfamoyl group, a carboxy group, a cyano group, a hydroxy group, an amino group, an acylamino group, an alkoxy group or an aryl group, or $V_1$ and $V_2$, or $V_3$ and $V_4$ may be bound to each other to form a benzene ring;

$R_1$ and $R_2$, which may be the same or different, each represents an alkyl group and may optionally form a salt with a metal atom or other organic compound;

$X^{\ominus}$ represents an anion; and l represents 0 or 1 or, when the dye forms an inner salt, l represents 0;

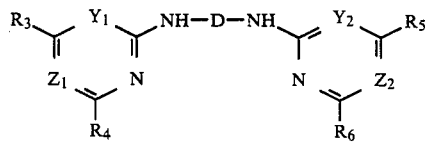

(II)

wherein

D represents a divalent aromatic moiety;

$R_3$, $R_4$, $R_5$ and $R_6$ each represents a hydrogen atom, a hydroxy group, an alkoxy group, an aryloxy group, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group;

$Y_1$ and $Y_2$ each represents —N= or —CH=; and $Z_1$ and $Z_2$ each represents —N= or —CH=;

further, at least one of $Y_1$ and $Z_1$ is —N=, and at least one of $Y_2$ and $Z_2$ is —N=.

DETAILED DESCRIPTION OF THE INVENTION

Japanese Patent Application (OPI) No. 202436/85 (the term "OPI" as used herein refers to a "published unexamined Japanese patent application") proposes to use bridged-structure red-sensitizing dyes including the spectral sensitizing dyes represented by the formula (I) and 1,3,5-triazine type hardeners in combination, but does not teach the combined use of the compounds of the formula (I) and the compounds of the formula (II) at all. Further, 1,3,5-triazine type compounds of U.S. Pat. No. 4,618,570 is different from the compounds represented by formula (II) with respect to structure of their compounds. That is, the compounds of U.S. Pat. No. 4,618,570 have a halogen atom as a substituent of a N-heterocyclic ring, and thereby have the function of a hardening agent as the compounds containing a halogen atom. Further, there is no concrete disclosure in the U.S. Pat. No. 4,618,570 as to the basic skeleton, and the 1,3,5-triazine type compounds are added to a protective layer in the examples of U.S. Pat. No. 4,618,570.

It is quite unexpected that the combined use of these compounds not only markedly enhances spectral sensitivity but also remarkable improves shelf life properties.

In addition, when at least one, preferably both, of a group of $V_1$ and $V_2$ and a group of $V_3$ and $V_4$ in the formula (I) forms a benzene ring as a result of $V_1$ and $V_2$, or $V_3$ and $V_4$, being bound to each other, silver halide color photographic materials with excellent color reproducibility can be obtained.

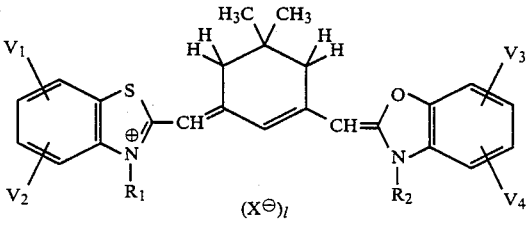

(I)

In the formula (I), $V_1$, $V_2$, $V_3$ and $V_4$ each represents a hydrogen atom, a halogen atom, an alkyl group, an acyl group, an acyloxy group, an alkoxycarbonyl group, a carbamoyl group, a sulfamoyl group, a carboxy group, a cyano group, a hydroxy group, an amino group, an acylamino group, an alkoxy group or an aryl group, or $V_1$ and $V_2$, or $V_3$ and $V_4$ may be bound to each other to form a benzene ring;

$R_1$ and $R_2$, which may be the same or different, each represents an alkyl group optionally forming a salt with a metal atom or other organic compound;

$X^{\ominus}$ represents an anion; and l represents 0 or 1 and, when the dye forms an inner salt, l represents 0.

The alkyl group (also containing an alkyl moiety), carbamoyl group, sulfamoyl group, amino group, and aryl group (also containing an aromatic moiety) as described above or below include those which are further substituted. The term "heterocyclic groups" and the like described below include those which are further substituted as above.

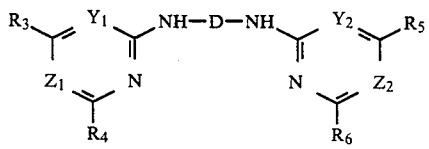

(II)

In the formula (II), D represents a divalent aromatic moiety;

$R_3$, $R_4$, $R_5$ and $R_6$ each represents a hydrogen atom, a hydroxy group, an alkoxy group, an aryloxy group, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group;

$Y_1$ and $Y_2$ each represents —N= or —CH=; and $Z_1$ and $Z_2$ each represents —N= or —CH=;

further at least one of $Y_1$ and $Z_1$ is —N=, and at least one of $Y_2$ and $Z_2$ is —N=.

The formula (I) is described in detail below.

Preferable examples of $V_1$, $V_2$, $V_3$ and $V_4$ of the compounds represented by the formula (I) include a hydrogen atom, a halogen atom (e.g., a chlorine atom, a fluorine atom, a bromine atom, etc.), an unsubstituted alkyl group containing preferably up to 10 carbon atoms (e.g., a methyl group, an ethyl group, etc.), a substituted alkyl group containing preferably up to 18 carbon atoms (e.g., a benzyl group, an α-naphthylmethyl group, a 2-phenylethyl group, a trifluoromethyl group, etc.), an acyl group containing preferably up to 10 carbon atoms (e.g., an acetyl group, a benzoyl group, a mesyl group, etc.), an acyloxy group containing preferably up to 10 carbon atoms (e.g., an acetoxy group, etc.), an alkoxycarbonyl group containing preferably up to 10 carbon atoms (e.g., a methoxycarbonyl group, an ethoxycarbonyl group, a benzyloxycarbonyl group, etc.), a substituted or unsubstituted carbamoyl group (e.g., a carbamoyl group, an N,N-dimethylcarbamoyl group, a morpholinocarbonyl group, a piperidinocarbonyl group, etc.), a substituted or unsubstituted sulfamoyl group (e.g., a sulfamoyl group, an N,N-dimethylsulfamoyl group, a morpholinosulfonyl group, a piperidinosulfonyl group, etc.), a carboxy group, a cyano group, a hydroxy group, a substituted or unsubstituted amino group (e.g., an amino group, a methylamino group, a dimethylamino group, etc.), an acylamino group containing preferably up to 8 carbon atoms (e.g., an acetylamino group, etc.), an alkoxy group containing preferably up to 10 carbon atoms (e.g., a methoxy group, an ethoxy group, a benzyloxy group, etc.), and a substituted or unsubstituted aryl group (e.g., a phenyl group, a tolyl group, a 4-methoxyphenyl group, etc.). In addition, $V_1$ and $V_2$, or $V_3$ and $V_4$ may be bound to each other to form a benzene ring. (In this case, a nucleus of, for example, α-naphthothiazole or oxazole, β,β'-naphthothiazole or oxazole, or β-naphthothiazole or oxazole is formed.)

$R_1$ and $R_2$ may be the same or different and each preferably represents an unsubstituted alkyl group containing up to 18 carbon atoms (e.g., a methyl group, an ethyl group, a propyl group, a butyl group, a pentyl group, an octyl group, a decyl group, a dodecyl group, an octadecyl group, etc.) or a substituted alkyl group containing up to 18 carbon atoms substituted by one or more of substituents [examples of the substituents being a carboxy group, a sulfo group, a cyano group, a halogen atom (e.g., a fluorine atom, a chlorine atom, a bromine atom, etc.), a hydroxy group, an alkoxycarbonyl group containing up to 8 carbon atoms (e.g., a methoxycarbonyl group, an ethoxycarbonyl group, a phenoxycarbonyl group, a benzyloxycarbonyl group, etc.), an alkoxy group containing up to 8 carbon atoms (e.g., a methoxy group, an ethoxy group, a propoxy group, a butoxy group, a benzloxy group, a phenethyloxy group, etc.), a monocyclic aryloxy group containing up to 10 carbon atoms (e.g., a phenoxy group, a p-tolyloxy group, etc.), an acyloxy group containing up to 3 carbon atoms (e.g., an acetyloxy group, a propionyloxy group, etc.), an acyl group containing up to 8 carbon atoms (e.g., an acetyl group, a propionyl group, a benzoyl group, a mesyl group, etc.), a carbamoyl group (e.g., a carbamoyl group, an N,N-dimethylcarbamoyl group, a morpholinocarbonyl group, a piperidinocarbonyl group, etc.), a sulfamoyl group (e.g., a sulfamoyl group, an N,N-dimethylsulfamoyl group, a morpholinosulfonyl group, a piperidinosulfonyl group, etc.), an aryl group containing up to 10 carbon atoms (e.g., a phenyl group, a 4-chlorophenyl group, a 4-methylphenyl group, an α-haphthyl group, etc.)].

Particularly preferably, $R_1$ and $R_2$ each represents an unsubstituted alkyl group (e.g., a methyl group, an ethyl group, a propyl group, etc.).

As the metal atom capable of forming a salt with $R_1$ or $R_2$, alkali metals are particularly preferable and, as the organic compound capable of forming a salt with $R_1$ or $R_2$, pyridines and amines are preferable.

$X^{\ominus}$ specifically represents an inorganic anion or an organic anion, such as a halide ion (e.g., a fluoride ion, a chloride ion, a bromide ion, an iodide ion, etc.), a substituted arylsulfonate ion (e.g., a p-toluenesulfonate ion, a p-chlorophenylsulfonate ion, etc.), an aryldisulfonate ion (e.g., a 1,3-benzenedisulfonate ion, a 1,5-naphthalenedisulfonate ion, a 2,6-naphthalenedisulfonate ion, etc.), a sulfate ion, a thiocyanate ion, a perchlorate ion, etc., with an iodide ion, a p-toluenesulfonate ion, and a perchlorate ion being preferable.

Typical examples of the compounds represented by the formula (I) are illustrated below which, however, do not limit the present invention in any way.

(I-1)

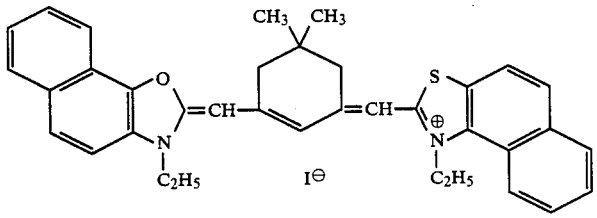

(I-2)

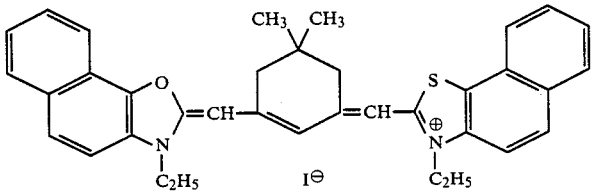

(I-3)

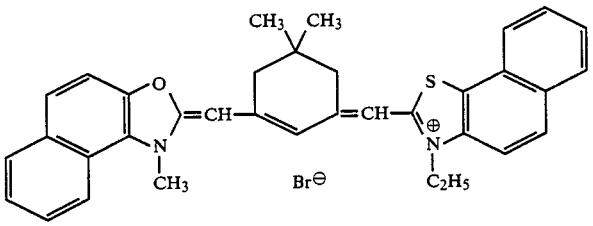

(I-4)

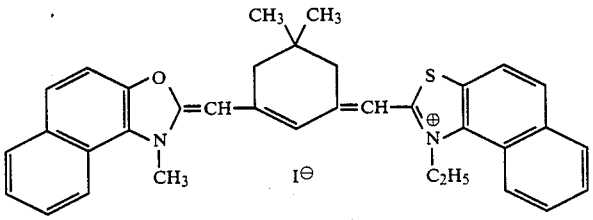

-continued
(I-5)
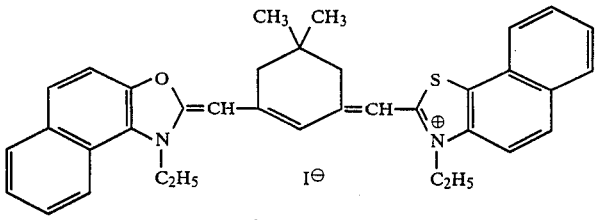
(I-6)
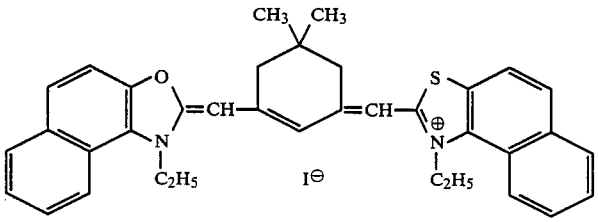
(I-7)
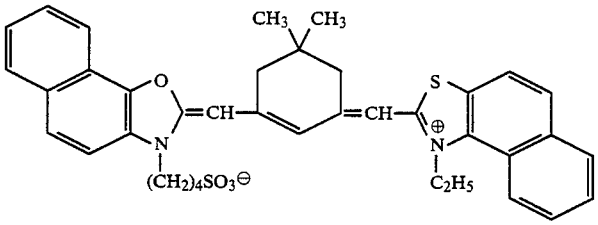
(I-8)
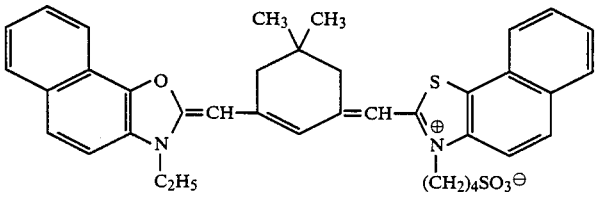
(I-9)
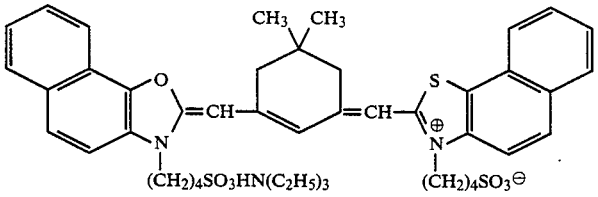
(I-10)
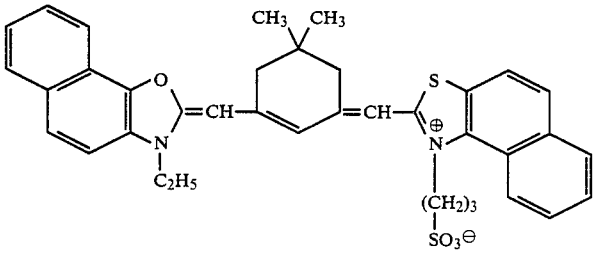

-continued
(I-11)
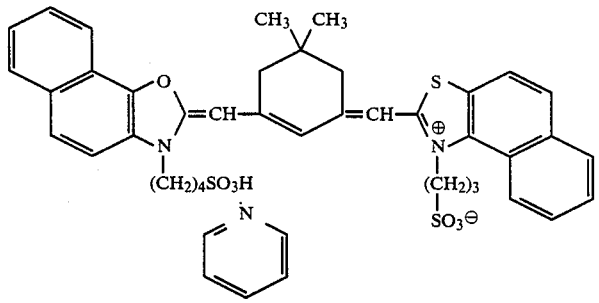
(I-12)
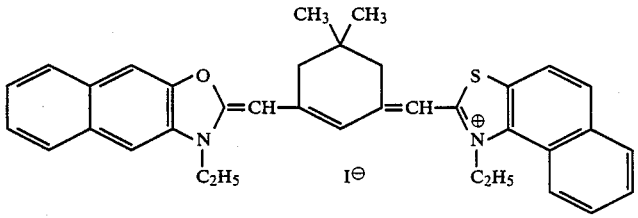
(I-13)
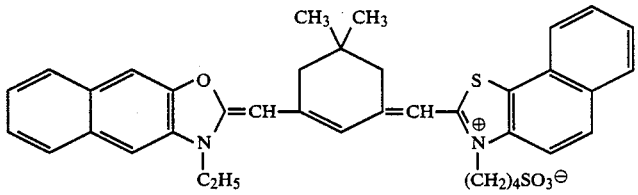
(I-14)
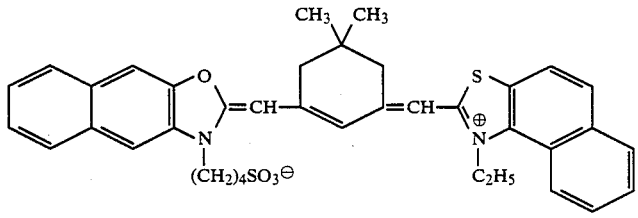
(I-15)
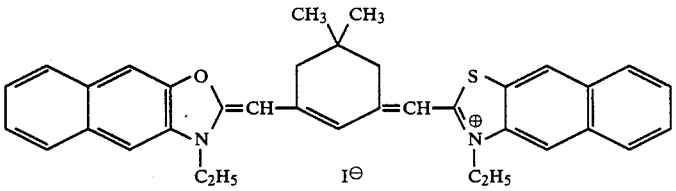
(I-16)
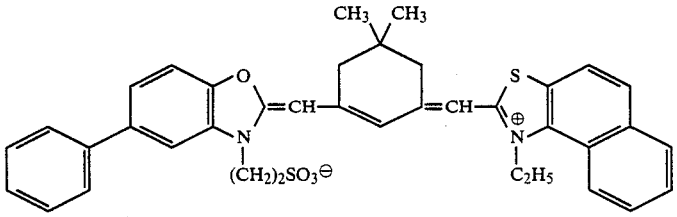

-continued
(I-17)
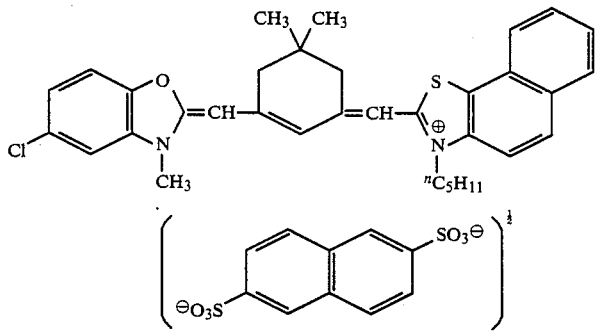
(I-18)
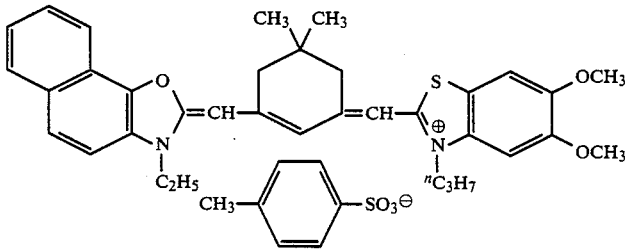
(I-19)
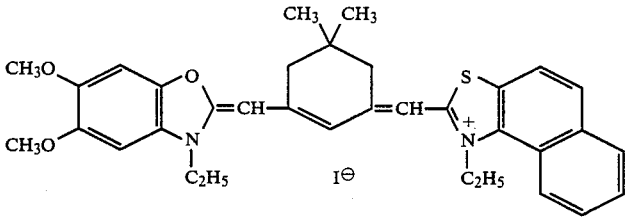
(I-20)
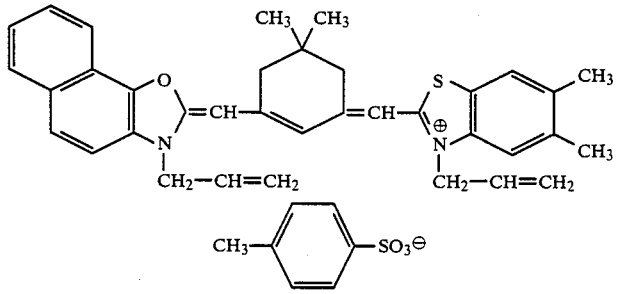
(I-21)
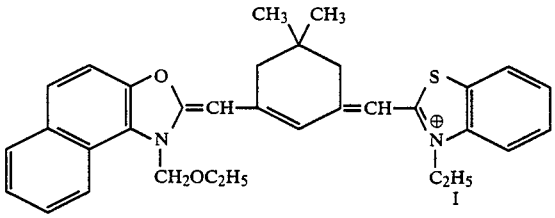
(I-22)
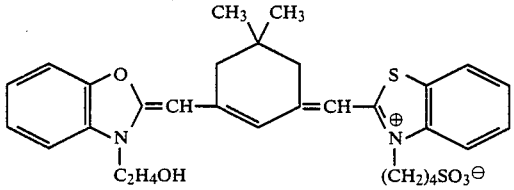

-continued (I-23)

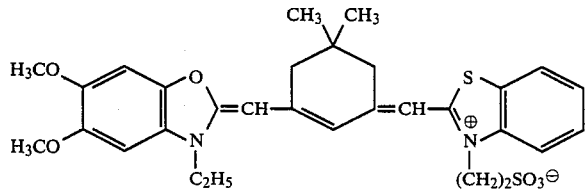

(I-24)

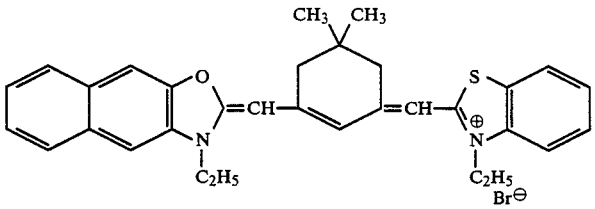

The compounds of the formula (I) to be used in the present invention are known compounds and can be synthesized according to processes described in F. M. Hamer, *Heterocyclic Compounds-Cyanine Dyes and Related Compounds*, Chapter IX, pp. 270–287 (John Wiley & Sons, New York, London, 1964), D. M. Sturmer, *Heterocyclic Compounds-Special Topics in Heterocyclic Chemistry*, Chapter 8, Section 4, pp. 482–515 (John Wiley & Sons, New York London, 1977), etc.

The formula (II) is described in detail below.

D represents a divalent aromatic moiety (for example, a single aromatic nucleus moiety, a moiety wherein at least two aromatic nuclei are fused to each other, a moiety wherein at least two aromatic nuclei are bound to each other directly or through an atom or atoms, a moiety containing, specifically, a biphenyl skeleton, a naphthylene skeleton, a stilbene skeleton, a bibenzyl skeleton, or the like). Those represented by the following $D_1$ and $D_2$ are particularly preferable. $D_1$:

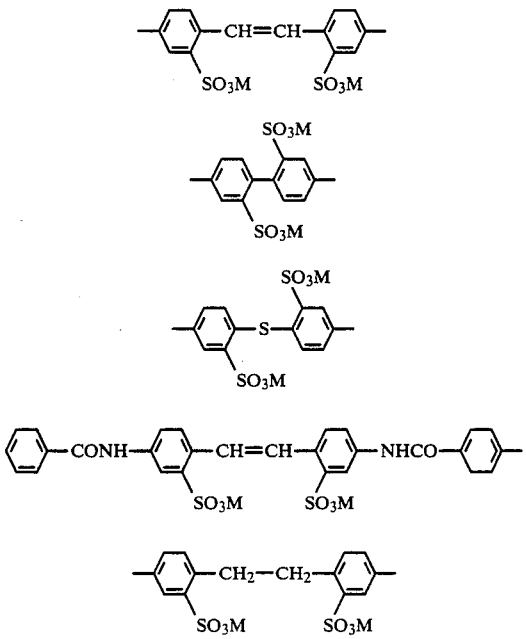

-continued

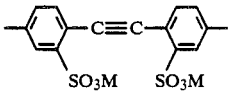

In the above formulae, M represents a hydrogen atom or a cation capable of giving water solubility (for example, an alkali metal ion (e.g., Na, K, etc.), an ammonium ion, etc.).

$Y_1$ and $Y_2$ each represents —N= or —CH=. $Z_1$ and $Z_2$ each represents —N= or —CH=. With the proviso that, at least one of $Y_1$ and Z and at least one of $Y_2$ and $Z_2$ are —N=. In view of the synthesis, a compound represented by formula (II-a) in which all of $Z_1$, $Z_2$, $Y_1$ and $Y_2$ are —N= is preferred.

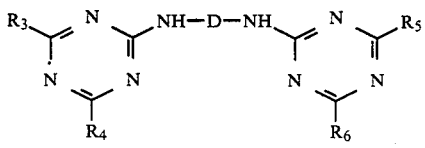

(II-a)

Further, in view of the synthesis, the sensitizing ability, and the shelf life property, a compound represented by formula (II-b) in which $Y_1$ and $Y_2$ are —N=, and $Z_1$ and $Z_2$ are —CH= is preferred.

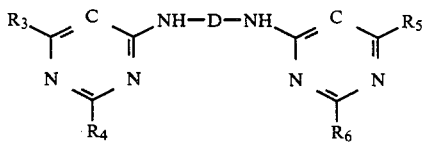

(II-b)

$D_2$:_____

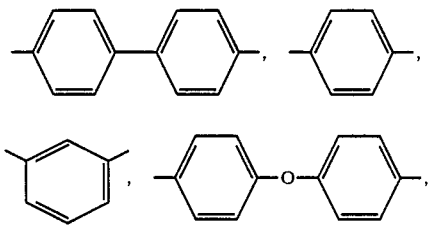

-continued

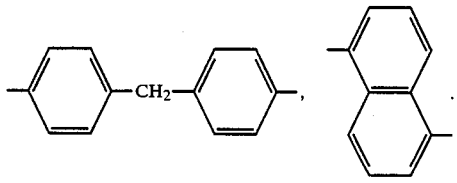

When D represents $D_2$, at least one of $R_3$, $R_4$, $R_5$ and $R_6$ preferably has a substituent having $SO_3M$ (wherein M is the same as defined above), more preferably has the $D_1$, and most preferably has

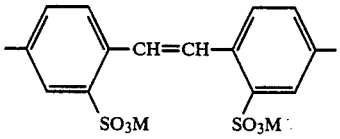

$R_3$, $R_4$, $R_5$ and $R_6$ each represents a hydrogen atom, a hydroxy group, an alkoxy group (e.g., a methoxy group, an ethoxy group, etc.), an aryloxy group (e.g., a phenoxy group, a naphthoxy group, an o-toluoxy group, a p-sulfophenoxy group, etc.), a substituted or unsubstituted heterocyclic group, (e.g., a morpholinyl group, a piperidyl group, a 2-methoxymorpholinyl group, etc.), a mercapto group, an alkylthio group (e.g., a methylthio group, an ethylthio group, etc.), an arylthio group (e.g., a phenylthio group, a tolylthio group, etc.), a heterocyclylthio group (e.g., a benzothiazolylthio group, a benzimidazolylthio group, a phenyltetrazolylthio group, etc.), an amino group, an alkylamino group (e.g., a methylamino group, an ethylamino group, a propylamino group, a dimethylamino group, a diethylamino group, a dodecylamino group, a β-hydroxyethylamino group, a di-β-hydroxyethylamino group, a β-sulfoethylamino group, etc.), a cyclohexylamino group, an arylamino group (e.g., an anilino group, an o-, m- or p-sulfoanilino group, an o-, m- or p-chloroanilino group, an o-, m- or p-anisidino group, an o-, m- or p-toluidino group, an o-, m- or p-carboxyanilino group, a hydroxyanilino group, a sulfonaphthylamino group, an o-, m- or p-aminoanilino group, an o-acetaminoanilino group, etc.), a heterocyclylamino group (e.g., a 2-benzothiazolylamino group, a 2-pyridylamino group, etc.), an aralkylamino group (e.g., a benzylamino group, etc.), or a substituted or unsubstituted aryl group (e.g., a phenyl group, a tolyl group, a 4-chlorophenyl group, a 4-methoxyphenyl group, etc.).

Of the compounds represented by the formula (II), those in which at least one of $R_3$ to $R_6$ represents an aryloxy group, a heterocyclylthio group or a heterocyclylamino group are particularly preferable.

Typical examples of the compounds represented by the formula (II) are illustrated below which, however, are not limitative at all.

(II-1): Disodium 4,4'-bis[2,6-di(benzothiazolyl-2-thio)-pyrimidine-4-ylamino]stilbene-2,2'-disulfonate (II-2): Disodium 4,4'-bis[2,6-di(benzothiazolyl-2-amino)pyrimidine-4-ylamino]stilbene-2,2'-disulfonate (II-3): Disodium 4,4'-bis[2,6-di(1-phenyltetrazolyl-5-thio)pyrimidine-4-ylamino]stilbene-2,2'-disulfonate (II-4): Disodium 4,4'-bis[2,6-di(benzimidazolyl-2-thio)-pyrimidine-4-ylamino]stilbene-2,2'-disulfonate (II-6): Disodium 4,4'-bis[2,6-di(naphthyl-2-oxy)pyrimidin-4-ylamino]stilbene-2,2'-disulfonate (II-7): Disodium 4,4'-bis[2,6-di(naphthyl-2-oxy)pyrimidine-4-ylamino]bibenzyl-2,2'-disulfonate (II-8): Disodium 4,4'-bis(2,6-diphenoxypyrimidine-4-ylamino)stilbene-2,2'-disulfonate (II-9): Disodium 4,4'-bis(2,6-diphenylthiopyrimidine-4-ylamino)stilbene-2,2'-disulfonate (II-11): Disodium 4,4'-bis(2,6-dianilinopyrimidine-4-ylamino)stilbene-2,2'-disulfonate (II-12): Disodium 4,4'-bis[4,6-di(naphthyl-2-oxy)triazin-2-ylamino]stilbene-2,2'-disulfonate (II-13): Disodium 4,4'-bis(4,6-dianilinotriazin-2-ylamino)stilbene-2,2'-disulfonate (II-14): Disodium 4,4'-bis(2,6-dimercaptopyrimidine-4-ylamino)biphenyl-2,2'-disulfonate (II-15): Disodium 4,4'-bis[4,6-di(naphthyl-2-oxy)pyrimidine-2-ylamino]stilbene-2,2'-disulfonate (II-16): Disodium 4,4'-bis[4,6-di(benzothiazolyl-2-thio)-pyrimidine-2-ylamino]stilbene-2,2'-disulfonate (II-17): Disodium 4,4'-bis[4,6-di(1-phenyltetrazolyl-2-amino)pyrimidine-2-ylamino]stilbene-2,2'-disulfonate (II-18): Disodium 4,4'-bis[4,6-di(naphthyl-2-oxy)pyrimidin-2-ylamino]bibenzyl-2,2'-disulfonate (II-19): Disodium 4,4'-bis[4,6-di(benzothiazolyl-2-thio)-triazin-2-ylamino]biphenyl-2,2'-disulfonate (II-20): Disodium 4,4'-bis[4-(2-carboxyethylamino)-6-(4-carboxyphenylamino)triazin-2-ylamino]stilbene-2,2'-disulfonate (II-21): 4,4'-bis[2,6-di(naphthyl-2-oxy)pyrimidine-4-ylamino]stilbene (II-22): 4,4'-bis[2,6-di(naphthyl-2-oxy)pyrimidine-4-ylamino]biphenyl Among these specific examples, Compounds (II-2), (II-3), (II-4), (II-6), (II-7) and (II-11) are particularly preferred.

The above compounds represented by the formula (II) can be synthesized by a method as described in Japanese Patent Publication No. 32741/70.

In addition of the compound (I) and the compound (II) in accordance with the present invention to a silver halide emulsion, processes well known in the art may be employed. Usually, they are dissolved in a water-soluble solvent of methanol, ethanol, pyridine, methyl cellosolve, acetone, etc., alone or in combination, and the resulting solution is added to a silver halide emulsion. Alternatively, they may be dissolved in a mixed solvent of the above-described organic solvent and water, followed by adding the resulting solution to a silver halide emulsion.

As to the stage of addition, the compounds may be added at any stage in the steps of preparing silver halide emulsions. However, the addition is preferably conducted during chemical ripening, or after completion of chemical ripening and before or after addition of a stabilizer and an antifoggant.

As to the order of adding the compound (I) and the compound (II) described above, either of them may be added first, or both of them may be added at the same time. In addition, the compound (I) and the compound (II) may be added in the form of a mixed solution.

The amounts of the compound (I) and the compound (II) in accordance with the present invention are not particularly limited. However, the compound (I) can suitably be added in an amount of generally from $1\times10^{-6}$ to $1\times10^{-3}$ mol, preferably from $1\times10^{-5}$ to $5\times10^{-4}$ mol, and particularly preferably from $5\times10^{-5}$ to $3\times10^{-4}$ mol, per mol of silver halide, and the compound (II) can suitably be added in an amount of generally from $1\times10^{-6}$ to $1\times10^{-1}$ mol, preferably from $5\times10^{-5}$ to $1\times10^{-2}$ mol, and particularly preferably from $1\times10^{-4}$ to $1\times10^{-3}$ mol, per mol of silver halide. A molar ratio of the compound (I) to the compound (II) to be added can be preferably from 1/100 to 10/1, and particularly preferably from 1/50 to 5/1.

As the silver halide composition of the silver halide grains to be used in the present invention, silver chlorobromide or silver chlorobromoiodide is preferably used. A mixture of silver chloride and silver bromide, etc., is also usable. That is, in the present invention, rapid developing speed and excellent processability are required in the case of using silver halide emulsions for color photographic printing paper, and hence chlorine atoms are preferably contained in the halide composition of silver halide, with silver chlorobromide or silver chlorobromoiodide containing at least 1 mol % of silver chloride being preferable. A particularly preferable silver chloride content is not less than 10 mol %. When silver chlorobromoiodide is used as the silver halide in the present invention, the content of silver iodide is preferably up to 2 mol %.

The silver halide emulsion to be used in the present invention has an average grain size of from 0.1 μm to 2 μm, and more preferably from 0.2 μm to 1.3 μm, in terms of the diameter of a circle with an equivalent projected area. The emulsion is preferably a monodispersed emulsion and has a grain size distribution of generally up to 0.2 and preferably up to 0.15, in terms of the ratio ($s/\bar{d}$) of statistical standard deviation (s) to average grain size ($\bar{d}$) which shows the degree of monodispersion.

Silver halide grains to be used in the present invention may have a crystal structure wherein the inner portion and the surface portion are different from each other in halide composition, a multiphase crystal structure having conjunction structure, or a wholly uniform phase. Further, a mixture of these structures is also employable.

As to the form of silver halide grains to be used in the present invention, the grains may be either of regular crystal form such as a cube, octahedron, dodecahedron, or tetradecahedron or of irregular crystal form such as a sphere, or may be a composite form of these crystal forms. Tabular silver halide grains may also be used. Emulsions wherein tabular grains having length/thickness ratio of preferably 5 or more, and particularly preferably 8 or more, account for 50% or more of the total projected area of the grains may be used. Emulsions comprising a mixture of grains of these various crystal forms may also be used. These various emulsions may be of the surface latent image type forming latent images mainly on the surface of the grains or of the internal latent image type forming latent images mainly inside the grains. In the case of using the internal latent image-forming emulsions, direct positive images can be obtained by conducting fogging processing in advance of or during color development.

Further, emulsions prepared by the so-called conversion method wherein silver halide grains already formed are converted to silver halide grains having a lower solubility product before completion of the formation of silver halide grains and emulsions having been subjected to the same halogen conversion after completion of the formation of silver halide grains are also usable.

During formation or physical ripening of silver halide grains, cadmium salts, zinc salts, lead salts, thallium salts, tridium salts or complex salts thereof, rhodium salts or complex salts thereof, iron salts or complex salts thereof, etc., may coexist.

After being formed, the silver halide emulsion is coated usually after being subjected to physical ripening, desalting and chemical ripening.

Known silver halide solvents (e.g., ammonia, potassium rhodanide, and thioethers and thione compounds described in U.S. Pat. No. 3,271,157, Japanese Patent Application (OPI) Nos. 12360/76, 82408/78, 144319/78, 100717/79, 155828/79, etc.) may be used in the steps of precipitation, physical ripening, and chemical ripening. In order to remove soluble silver salts from physically ripened emulsions, a noodle washing process, a flocculation process, an ultrafiltration process, etc., may be employed.

The silver halide emulsion to be used in the present invention may be chemically sensitized by employing sulfur or selenium sensitization, reduction sensitization, noble metal sensitization, etc., alone or in combination.

That is, sulfur sensitization using active gelatin or sulfur-containing compounds capable of reacting with silver (e.g., thiosulfates, thioureas, mercapto compounds, rhodanines, etc.); reduction sensitization using a reductive substance (e.g., stannous salts, amines, hydrazine derivatives, formamidinesulfinic acids, silane compounds, etc.; noble metal sensitization using metal compounds (e.g., complexes of the group VIII metals such as Pt, Ir, Pd, Rh, Fe, etc., as well as gold complexes); and the like are employed alone or in combination. In addition, upon conducting these various sensitization processes, stabilizing agents such as nucleic acids or their decomposed products, compounds having a purine nucleus or a pyrimidine nucleus, or hydroxytetraazaindenes may coexist.

In order to attain good gradation which the photographic light-sensitive material of the present invention is intended to acquire, two or more monodispersed emulsions (each having a monodispersibility of, preferably, the foregoing degree of variability) different from each other in grain size may be coated as a mixture in one and the same layer or as different layers with substantially the same color sensitivity. In addition, two or more polydispersed silver halide emulsions or a combination of a monodispersed emulsion and a polydispersed emulsion may be coated as a mixture or as different layers.

In the present invention, cyan couplers may be used as color image-forming compounds. Among them, oil protection type naphtholic and phenolic couplers are preferably used. Typical examples thereof include naphtholic couplers described in U.S. Pat. No. 2,474,293, preferably oxygen atom-releasing type 2-equivalent naphtholic couplers described in U.S. Pat. Nos. 4,052,212, 4,146,396, 4,228,233 and 4,296,200. Specific examples of the phenolic couplers are described in U.S. Pat. Nos. 2,369,929, 2,801,171, 2,772,162, 2,895,826, etc. Cyan couplers capable of forming dyes fast against high humidity and high temperature are preferably used in the present invention, and typical examples thereof include phenolic cyan couplers having an alkyl group containing 2 or more carbon atoms at the m-position of the phenol nucleus described in U.S. Pat. No. 3,772,002; 2,5-diacylamino-substituted phenolic couplers described in U.S. Pat. Nos. 2,772,162, 3,758,308, 4,126,396, 4,334,011, 4,327,173, West German Patent (DT-OS) No. 3,329,729, Japanese Patent Application (OPI) No. 166956/84, etc., and phenolic couplers having a phenylureido group in the 2-position and an acylamino group in the 5-position described in U.S. Pat. Nos. 3,446,622, 4,333,999, 4,451,559, 4,427,767, etc.

Color couplers to be incorporated in light-sensitive materials preferably have a ballast group or are polymerized to acquire diffusion resistance. In comparison with 4-equivalent couplers having hydrogen atoms in coupling-active sites, 2-equivalent couplers substituted by releasing groups in coupling-active sites permit a reduction of the amount of coated silver. Couplers which can form color dyes with suitable diffusibility, non-color-forming couplers, DIR couplers capable of releasing a development inhibitor upon a coupling reaction, or couplers capable of releasing a development inhibitor may also be used.

In the present invention, magenta and yellow couplers may be used in addition to the aforesaid cyan couplers.

Typical examples thereof include pyrazolone or pyrazoloazole compounds and open chain or heterocyclic ketomethylene compounds. Specific examples of these magenta and yellow couplers to be used in the present invention are described in patents cited in *Research Disclosure*, RD-17643 (Dec., 1978), VII-D and ibid., RD-18717 (Nov., 1979).

Two or more of the various couplers to be used in the present invention may be used in one and the same layer, or one and the same compound may be introduced into two or more different layers, for obtaining properties required for light-sensitive materials.

The couplers to be used in the present invention may be introduced into a light-sensitive material according to various known dispersing processes. Typical examples thereof include a solid dispersion process, an alkali dispersion process, preferably a polymer dispersion process, an oil-in-water dispersion process, etc. In the oil-in-water dispersion process, the couplers are first dissolved in a single solution or a mixed solution of high boiling organic solvents having a boiling point of 175° C. or more and low boiling auxiliary solvents having a boiling point of from 60° to 150° C., then finely dispersed in water or an aqueous medium such as a gelatin aqueous solution in the presence of a surfactant. Examples of the high boiling organic solvents are described in U.S. Pat. No. 2,322,027, etc.

As the aforesaid polymer dispersion process, there are illustrated processes of using water-insoluble and organic solvent-soluble polymers described in Japanese Patent Publication No. 30474/73, U.S. Pat. No. 3,619,195, Japanese Patent Application No. 162813/86 (corresponding to PCT Application No. 00492/87 filed on Jul. 9, 1987), etc., and processes of using loadable polymer latexes described in U.S. Pat. No. 4,203,716.

Standard amounts of the couplers range from 0.001 to 1 mol per mol of light-sensitive silver halide, preferably from 0.01 to 0.5 mol with respect to yellow couplers, from 0.003 to 0.3 mol with respect to magenta couplers, and from 0.002 to 0.3 mol with respect to cyan couplers.

Various compounds may be incorporated in the photographic emulsion to be used in the present invention for the purpose of preventing fogging or stabilizing photographic properties during the preparation step or the storage of light-sensitive materials.

The light-sensitive material to be prepared by using the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color antifoggants or color mixing-preventing agents.

The light-sensitive material in accordance with the present invention may contain known antifading agents.

In the light-sensitive material of the present invention, an ultraviolet ray absorbent may be added to the hydrophilic colloidal layer.

The light-sensitive material of the present invention may contain an inorganic or organic hardener in its arbitrary hydrophilic colloidal layers constituting photographic light-sensitive layers or a backing layer.

The light-sensitive material of the present invention may contain one or more surfactants for various purposes, e.g., is a coating aid, as antistatic agents, for improvement of sliding properties, as emulsification and dispersing aids, for prevention of adhesion, for improvement of photographic characteristics (e.g., development acceleration, increase in contrast, increase in sensitivity, etc.). For example, the following Compound A may be used alone or in combination with the following Compound B for emulsification. Compound B can also be used for coating.

Compound A:

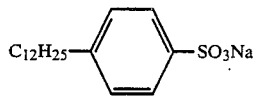

Compound B:

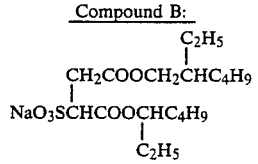

In addition, the following Compounds C and D may be used for coating protective layers, blue-sensitive layers, etc.

Compound C:

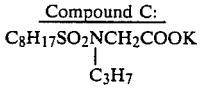

Compound D:

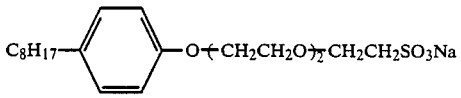

The light-sensitive material of the present invention may contain, in addition to the above-described additives, various stabilizers, stain-preventing agents, developing agents or their precursors, development accelerators or their precursors, lubricants, mordants, matting agents, antistatic agents, plasticizers, and other additives useful for photographic light-sensitive materials. Typical examples of these additives are described in *Research Disclosure*, RD-17643 (Dec., 1978) and ibid., RD-18716 (Nov., 1979).

The present invention may also be applied to a multilayered multicolor photographic material comprising a support having provided thereon at least two layers different from each other in spectral sensitivity. Multilayered natural color photographic materials usually comprise a support having provided thereon at least one red-sensitive emulsion layer, at least one green-sensitive emulsion layer, and at least one blue-sensitive emulsion layer. The order of these layers may be optionally selected as the case demands. Each of the aforementioned emulsion layers may be composed of two or more emulsion layers different from each other in sensitivity, and a light-insensitive layer may be provided between two or more emulsion layers having the same color sensitivity.

In the light-sensitive material of the present invention, auxiliary layers such as a protective layer, an interlayer, an antihalation layer, a backing layer, etc., may preferably be properly provided in addition to the silver halide emulsion layers.

In the photographic light-sensitive material of the present invention, photographic emulsion layers and other layers are coated on a flexible support such as plastic film, baryta paper, paper or cloth laminated with polyethylene or the like or a rigid support such as glass, porcelain, metal, etc. In addition, a support comprising a substrate having provided thereon, for example, a metal thin film or a support having a metal powder-filled layer to give the surface of mirror reflection or second diffuse reflectivity as described in Japanese Patent Application Nos. 168800/86 (corresponding to U.S. patent application Ser. No. 073,977 filed on Jul. 15, 1987) and 168801/86 (corresponding to U.S. patent application Ser. No. 073,767 filed on Jul. 15, 1987) may be used.

Of these, baryta paper and polyethylene-laminated paper support containing a white pigment (e.g., titanium oxide) in the polyethylene layer are preferred as supports to be used in the present invention.

The present invention may be applied to various light-sensitive materials, typically color papers and color positive-working films. In addition, the present invention is also applicable to black-and-white light-sensitive materials utilizing a mixture of three color couplers described in *Research Disclosure*, RD-17123 (Sept., 1978), etc.

The color developer to be used in the present invention is preferably an alkaline aqueous solution containing an aromatic primary amine color developing agent as a main ingredient. As this color developing agent, p-phenylenediamine type compounds are preferably used. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides, p-toluenesulfonates, etc., thereof.

After imagewise exposure and color development, the light-sensitive material of the present invention is subjected to bleaching and fixing (which may be conducted in a monobath).

As bleaching agents, there may be used organic complex salts of, for example, iron(III) or cobalt(III), such as complexes of aminopolycarboxylic acids (e.g., ethylenediaminetetraacetic acid, diethylenetriaminepentaacetic acid, nitrilotriacetic acid, 1,3-diamino-2-propanoltetraacetic acid, etc.) or organic acids (e.g., citric acid, tartaric acid, malic acid, etc.). Of these, a complex salt of iron(III) ethylenediaminetetraacetate and a complex salt of iron(III) ethylenetriaminepentaacetate are particularly useful in a bleach-fixing solution.

As fixing agents, there are illustrated thiosulfates, thiocyanates, thioether compounds, thioureas, a large amount of iodide, etc., with the use of thiosulfates being popular.

After the bleach fixing or fixing, water washing is usually conducted.

In the water washing step, two or more tanks are generally provided to conduct washing in a countercurrent manner for saving water. Further, a multistage countercurrent stabilizing step as described in Japanese Patent Application (OPI) No. 8543/82 may be conducted in place of the water washing step.

In order to simplify and accelerate the photographic processing, the color developing agents may be incorporated in light-sensitive materials. For this incorporation, various precursors of the color developing agents are preferably used.

In addition, various 1-phenyl-3-pyrazolidones may be incorporated for accelerating color development.

The present invention is now illustrated in more detail by reference to the following examples which, however, are not to be construed as limiting the present invention in any way. Unless otherwise specified, all percents, ratios, etc., are by weight.

EXAMPLE 1

A multilayer color photographic printing paper comprising a polyethylene double-laminated paper support having provided thereon the following layer construction was prepared. Coating solutions were prepared as follows.

Preparation of Coating Solution for Forming First Layer:

27.2 cc of ethyl acetate and 7.7 cc of a solvent (Solv-1) were added to 19.1 g of a yellow coupler (ExY) and 4.4 g of a color image stabilizer (Cpd-1) to prepare a solution. This solution was emulsified and dispersed in 185 cc of a 10% gelatin aqueous solution containing 8 cc of a 10% solution of sodium dodecylbenzenesulfonate. On the other hand, a silver chlorobromide emulsion (containing 80.0 mol % of silver bromide and 70 g/kg of silver) containing $5.0\times10^{-4}$ mol per mol of silver of a blue-sensitive sensitizing dye described below was prepared. The aforementioned emulsion dispersion and this emulsion were mixed, and a coating solution of the following formulation for forming the first layer was prepared using the mixture. Coating solutions for forming the second to seventh layers were prepared in the same manner as the coating solution for forming the first layer, except that a cyan coupler for the fifth layer was dissolved in a solvent (Solv-4) together with a polymer (Cpd-7) and emulsified and dispersed in a silver halide emulsion. As a gelatin hardener for each layer, 1-hydroxy-3,5-dichloro-s-triazine sodium salt was used.

The following spectral sensitizing dyes were used for respective layers.

Blue-Sensitive Emulsion Layer:

-continued

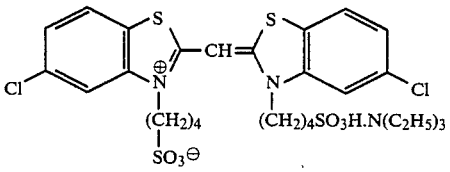

($5.0 \times 10^{-4}$ mol per mol of silver halide)

Green-Sensitive Emulsion Layer:

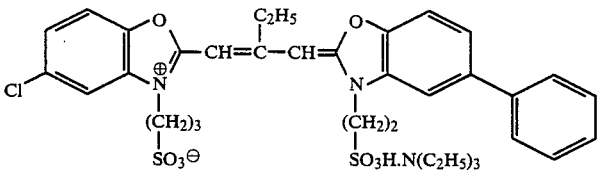

($4.0 \times 10^{-4}$ mol per mol of silver halide)

and

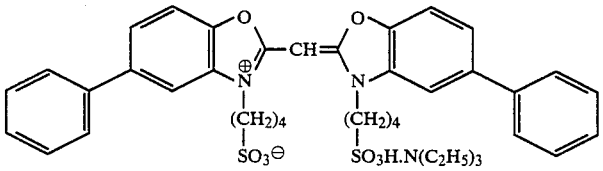

($7.0 \times 10^{-5}$ mol per mol of silver halide)

Red-Sensitive Emulsion Layer (Sensitizing Dye (1)):

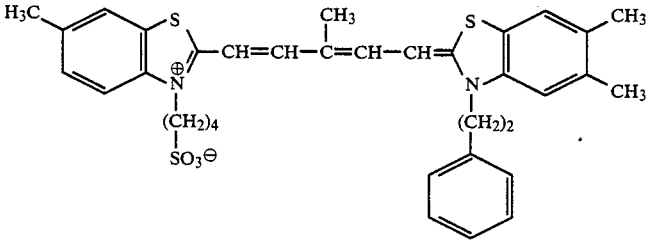

($0.9 \times 10^{-4}$ mol per mol of silver halide)

1-(5-Methylureidophenyl)-5-mercaptotetrazole was added to the blue-sensitive emulsion layer, green-sensitive emulsion layer, and red-sensitive emulsion layer in amounts of $4.0\times10^{-6}$ mol, $3.0\times10^{-5}$ mol, and $1.0\times10^{-5}$ mol, respectively, per mol of silver halide.

4-Hydroxy-6-methyl-1,3,3*a*,7-tetraazaindene was added to the blue-sensitive emulsion layer and the green-sensitive emulsion layer in amounts of $1.2\times10^{-2}$ mol and $1.1\times10^{-2}$ mol, respectively, per mol of silver halide.

The following dyes were added to the emulsion layers for preventing irradiation:

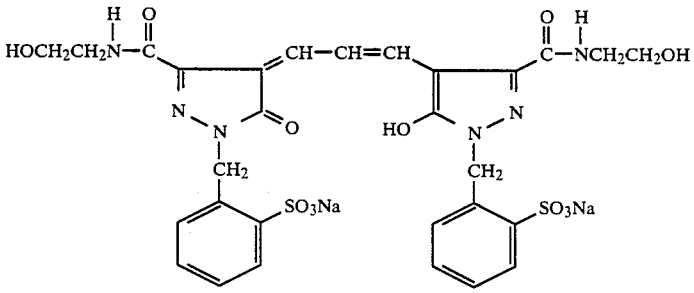

and

-continued

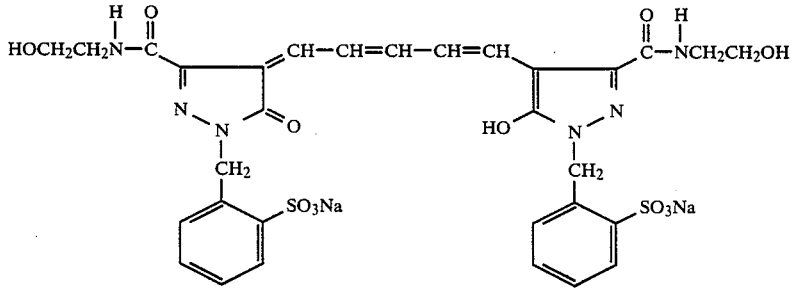

LAYER CONSTITUTION

Formulations of the respective layers are shown below. Numerical values show coated amounts in terms of g/m². Numerical values for silver halide emulsions show amounts of coated silver.

Support

Polyethylene-laminated paper (containing a white pigment ($TiO_2$) and a bluing dye (ultramarine) in polyethylene on the first layer side

| | |
|---|---|
| First Layer: Blue-Sensitive Emulsion Layer | |
| Silver halide emulsion (Br: 80 mol %) | 0.26 |
| Gelatin | 1.83 |
| Yellow coupler (ExY) | 0.83 |
| Color image stabilizer (Cpd-1) | 0.19 |
| Solvent (Solv-1) | 0.35 |
| Second Layer: Color Mixing-Preventing Layer | |
| Gelatin | 0.99 |
| Color mixing-preventing agent (Cpd-2) | 0.08 |
| Third Layer: Green-Sensitive Emulsion Layer | |
| Silver halide emulsion (Br: 80 mol %) | 0.16 |
| Gelatin | 1.79 |
| Magenta coupler (ExM-1) | 0.32 |
| Color image stabilizer (Cpd-3) | 0.20 |
| Color image stabilizer (Cpd-4) | 0.01 |
| Solvent (Solv-2) | 0.65 |
| Fourth Layer: Ultraviolet Ray-Absorbing Layer | |
| Gelatin | 1.58 |
| UV ray absorbent (UV-1) | 0.62 |
| Color mixing preventing agent (Cpd-5) | 0.05 |
| Solvent (Solv-3) | 0.24 |
| Fifth Layer: Red-Sensitive Emulsion Layer | |
| Silver halide emulsion (Br: 70 mol %) | 0.23 |
| Gelatin | 1.34 |
| Cyan coupler (ExC-1) | 0.34 |
| Color image stabilizer (Cpd-6) | 0.17 |
| Polymer (Cpd-7) | 0.40 |
| Solvent (Solv-4) | 0.23 |
| Sixth Layer: Ultraviolet Ray-Absorbing Layer | |
| Gelatin | 0.53 |
| UV ray absorbent (UV-1) | 0.21 |
| Solvent (Solv-3) | 0.08 |
| Seventh Layer: Protective Layer | |
| Gelatin | 1.33 |
| Acryl-modified copolymer of polyvinyl alcohol (modification degree: 17%) | 0.17 |
| Liquid paraffin | 0.03 |

(ExY) Yellow Coupler

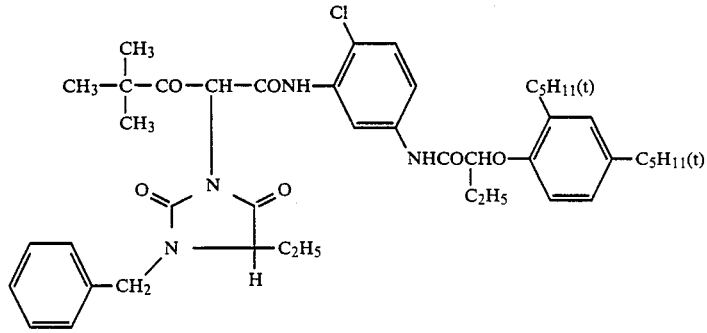

-continued
(ExM-1) Magenta Coupler
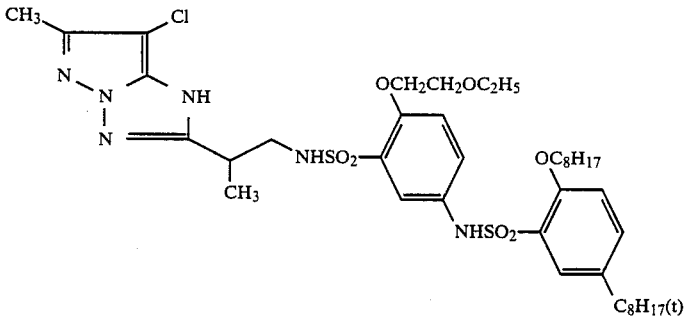
(ExC-1) Cyan Coupler
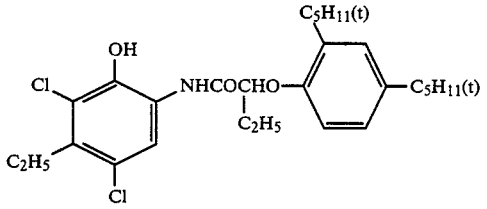
(Cpd-1) Color Image Stabilizer
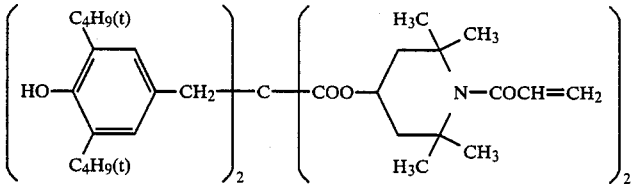
(Cpd-2) Color Mixing-Preventing Agent
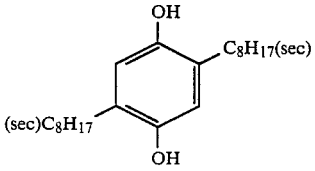
(Cpd-3) Color Image Stabilizer
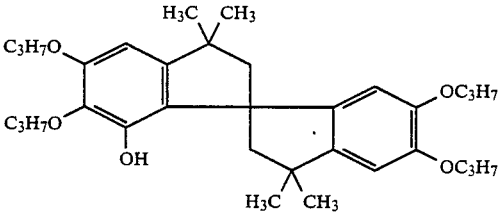
(Cpd-4) Color Image Stabilizer
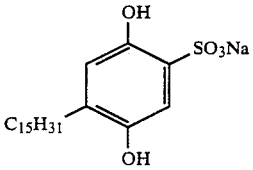
(Cpd-5) Color Mixing-Preventing Agent -continued
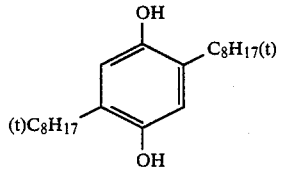
(Cpd-6) Color Image Stabilzer
A mixture (5/8/9 by weight) of:
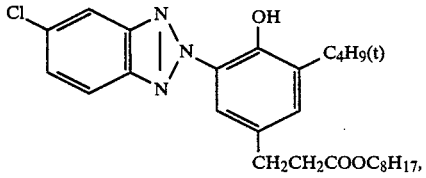
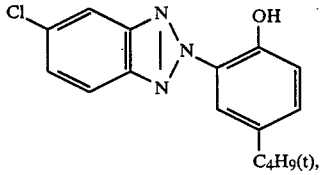
and
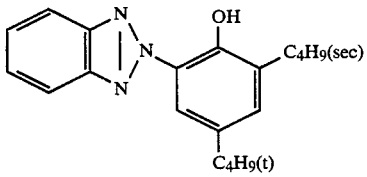
(Cpd-7) Polymer
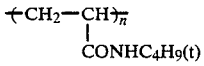
(average molecular weight: 80,000)
(UV-1) UV Ray Absorbent
A mixture (2/9/8 by weight) of:
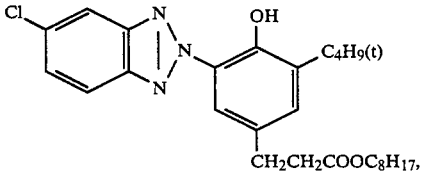
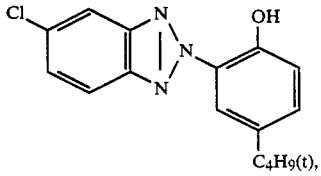
and -continued

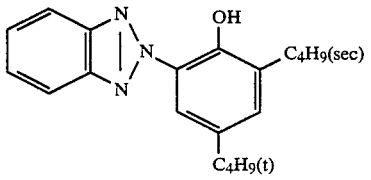

(Solv-1) Solvent

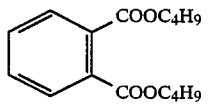

(Solv-2) Solvent

A mixture (2/1 by volume) of:

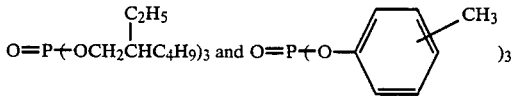

(Solv-3) Solvent $O{=}P{-}[{-}O{-}C_9H_{19}(iso)]_3$ (Solv-4) Solvent

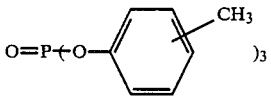

Silver halide emulsion (1) used in the red-sensitive emulsion layer was prepared as follows.

| | |
|---|---|
| Solution 1: | |
| $H_2O$ | 1,000 cc |
| NaCl | 5.5 g |
| Gelatin | 32 g |
| Solution 2: | |
| Sulfuric acid (1 N) | 24 cc |
| Solution 3: | |
| Silver halide solvent of the following structure (1%) | 3 cc |

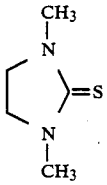

| | |
|---|---|
| Solution 4: | |
| KBr | 15.66 g |
| NaCl | 3.30 g |
| $H_2O$ (water) to make | 200 cc |
| Solution 5: | |
| $AgNO_3$ | 32 g |
| $H_2O$ to make | 200 cc |
| Solution 6: | |
| KBr | 62.72 g |
| NaCl | 13.22 g |
| $K_2IrCl_6$ (0.001%) | 4.54 cc |
| $H_2O$ to make | 600 cc |
| Solution 7: | |
| $AgNO_3$ | 128 g |

-continued

| | |
|---|---|
| $H_2O$ to make | 600 cc |

Solution 1 was heated to 56° C., and Solution 2 and Solution 3 were added thereto. Then, Solution 4 and Solution 5 were simultaneously added thereto over 30 minutes. After 10 minutes from the addition, Solution 6 and Solution 7 were simultaneously added thereto over 20 minutes. 5 minutes after the addition, the temperature of the solution was lowered to desalt. Water and dispersed gelatin were added thereto, and the pH was adjusted to 6.2 to obtain a monodispersed cubic silver chlorobromide emulsion of 0.45 μm in average grain size, 0.08 in coefficient of variation (value obtained by dividing standard deviation by average grain size), and 70 mol % in silver bromide content. Sodium thiosulfate was added to this emulsion to conduct optimal chemical sensitization.

Silver halide emulsions for the green-sensitive emulsion layer and the blue-sensitive emulsion layer were prepared in the same manner as described above, except for changing the amounts of chemicals, temperature and time. The thus-prepared silver halide emulsion for the green-sensitive emulsion layer was a monodispersed cubic silver chlorobromide emulsion of 0.60 μm in average grain size, 0.10 in coefficient of variation, and 80 mol % in silver bromide content, and the silver halide emulsion for the blue-sensitive emulsion layer was a monodispersed cubic silver chlorobromide emulsion of 0.90 μm in average grain size, 0.09 in coefficient of variation, and 80 mol % in silver bromide content.

The thus-prepared silver halide color photographic material was referred to as Sample 101.

Then, Samples 102 to 119 were prepared as shown in Table 1 in the same manner, except for adding a compound represented by the formula (I), Compound (a), Compound (b), Compound (c), Compound (d) or Compound (e) in place of the red-sensitive Sensitizing Dye (1) in an amount of $0.9\times10^{-4}$ mol per mol of silver halide and a compound represented by the formula (II), Compound (f) and Compound (g) in an amount of $2.6\times10^{-3}$ mol per mol of silver halide, as shown in Table 1. Compounds (a), (b), (c), (d), (e), (f) and (g) are compounds of the following structures. Other compounds shown in Table 1 are compounds having been referred to as specific examples.

Compound (a)

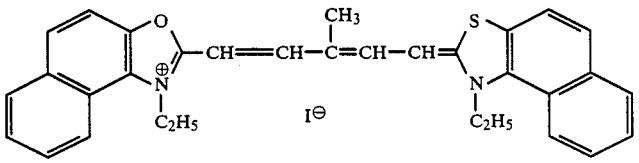

Compound (b)

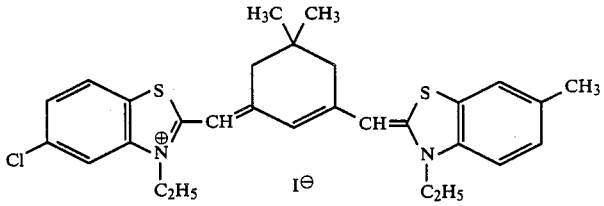

Compound (c)

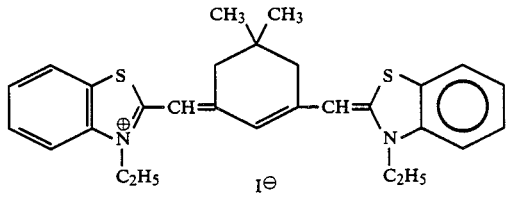

Compound (d)

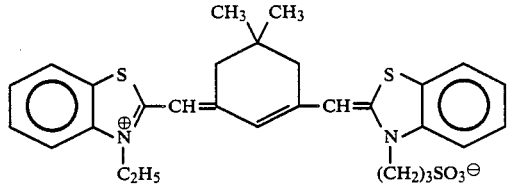

Compound (e)

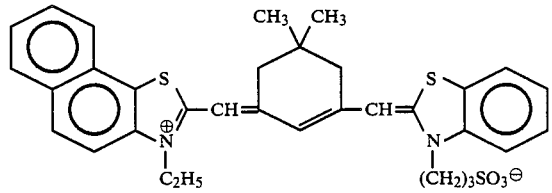

Compound (f)

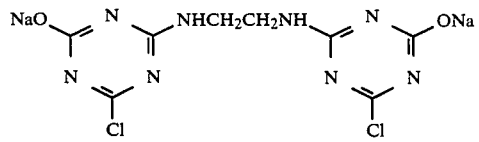

Compound (g)

-continued

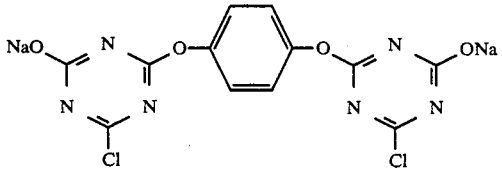

These samples were subjected to gradation exposure for sensitometry through a red filter using a sensitometer (made by Fuji Photo Film Co., Ltd.; model FWH; color temperature of light source: 3,200° K.), then developed according to the following processing steps. Additionally, the exposure was conducted for 0.5 second so as to give an exposure amount of 250 CMS.

| Processing Step | Temperature (°C.) | Time |
|---|---|---|
| Color Development | 33 | 3 min 30 sec |
| Bleach-Fixing | 33 | 1 min 30 sec |
| Washing with Water | 24–34 | 3 min |
| Drying | 70–80 | 1 min |

Formulations of respective processing solutions are shown below.

| | |
|---|---|
| Color Developer: | |
| Water | 800 ml |
| Diethylenetriaminepentaacetic Acid | 1.0 g |
| Nitrilotriacetic Acid | 1.5 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.0 g |
| Hydroxylamine Sulfate | 4.0 g |
| Fluorescent Brightening Agent (WHITEX 4B, manufactured by Sumitomo Chemical Co., Ltd.) | 1.0 g |
| Water to make | 1,000 ml |
| pH (25° C.) | 10.20 |
| Bleach-Fixing Solution: | |
| Water | 400 ml |
| Ammonium Thiosulfate (70%) | 150 ml |
| Sodium Sulfite | 18 g |
| Iron(III) Ammonium Ethylenediaminetetraacetate | 55 g |
| Disodium Ethylenediaminetetraacetate | 5 g |
| Water to make | 1,000 ml |
| pH (25° C.) | 6.70 |

Photographic properties were evaluated in terms of sensitivity and fog. Sensitivity was presented as a relative value of the logarithm of the exposure amount necessary for giving a density of 0.5 plus minimum density (fog). For convenience's sake, the sensitivity of a fresh sample (Fr.) is presented as a relative value taking the sensitivity of Sample 101 as 100. Shelf life properties were evaluated in terms of change in sensitivity and fog of samples stored for 2 days at 60° C. and 40% RH (storage-1) and samples stored for 2 days at 50° C. and 80% RH (storage-2) in comparison with corresponding fresh samples. Sensitivity in evaluating shelf life properties is presented as a relative sensitivity taking that of a fresh corresponding sample as 100. It is apparent from the results of Table 2 that samples of the present invention showed higher sensitivity and lower fog and undersent less changes in sensitivity and fog in the shelf life evaluation test in comparison with the comparative samples.

TABLE 1

| Sample No. | Emulsion | Compound (I) ($0.9 \times 10^{-4}$ mol/Ag - 1 mol) | Compound (II) ($2.6 \times 10^{-3}$ mol/Ag - 1 mol) | Comparative Compound ($0.9 \times 10^{-4}$ mol/Ag - 1 mol) | Remarks |
|---|---|---|---|---|---|
| 101 | (1) | — | — | Sensitizing Dye (1) | Comparison |
| 102 | " | — | — | Compound (a) | " |
| 103 | " | — | — | Compound (b) | " |
| 104 | " | (I-21) | — | — | " |
| 105 | " | (I-22) | — | — | " |
| 106 | " | (I-23) | — | — | " |
| 107 | " | (I-24) | — | — | " |
| 108 | " | (I-1) | — | — | " |
| 109 | " | — | (II-6) | Sensitizing Dye (1) | " |
| 110 | " | — | " | Compound (a) | " |
| 111 | " | — | " | Compound (b) | " |
| 112 | " | (I-21) | " | — | Invention |
| 113 | " | (I-22) | " | — | " |
| 114 | " | (I-23) | " | — | " |
| 115 | " | (I-24) | " | — | " |
| 116 | " | (I-1) | " | — | " |
| 117 | " | (I-4) | " | — | " |
| 118 | " | (I-1) | (II-2) | — | " |
| 119 | " | " | (II-13) | — | " |
| 120 | (1) | — | — | Compound (c) | Comparison |
| 121 | (1) | — | — | Compound (d) | " |
| 122 | (1) | — | — | Compound (e) | " |
| 123 | (1) | — | II-6 | Compound (c) | " |
| 124 | (1) | — | II-6 | Compound (d) | " |
| 125 | (1) | — | II-6 | Compound (e) | " |
| 126 | (1) | I-1 | — | Compound (f)* | " |
| 127 | (1) | I-1 | — | Compound (g)* | " |

TABLE 1-continued

| Sample No. | Emulsion | Compound (I) ($0.9 \times 10^{-4}$ mol/Ag - 1 mol) | Compound (II) ($2.6 \times 10^{-3}$ mol/Ag - 1 mol) | Comparative Compound ($0.9 \times 10^{-4}$ mol/Ag - 1 mol) | Remarks |
|---|---|---|---|---|---|
| 128 | (1) | I-1 | II-21 | — | Invention |
| 129 | (1) | I-1 | II-22 | — | " |
| 130 | (1) | I-1 | II-20 | — | " |
| 131 | (1) | I-1 | II-15 | — | " |

*The amount of Compound (f) and Compound (g) is $2.6 \times 10^{-4}$ mol/AgX-1 mol, respectively.

TABLE 2

| Sample No. | Sensitivity (Fr) | Fog (Fr) | Shelf Life Properties Storage-1 Sensitivity | Storage-1 Fog | Storage-2 Sensitivity | Storage-2 Fog | Remarks |
|---|---|---|---|---|---|---|---|
| 101 | 100 | 0.12 | 107 | 0.15 | 45 | 0.14 | Comparison |
| 102 | 125 | 0.12 | 105 | 0.16 | 50 | 0.13 | " |
| 103 | 132 | 0.12 | 102 | 0.15 | 52 | 0.13 | " |
| 104 | 142 | 0.12 | 101 | 0.14 | 54 | 0.13 | " |
| 105 | 150 | 0.12 | 105 | 0.15 | 70 | 0.13 | " |
| 106 | 181 | 0.12 | 103 | 0.13 | 35 | 0.13 | " |
| 107 | 125 | 0.12 | 101 | 0.14 | 55 | 0.13 | " |
| 108 | 141 | 0.12 | 102 | 0.15 | 56 | 0.13 | " |
| 109 | 398 | 0.12 | 105 | 0.14 | 76 | 0.13 | " |
| 110 | 525 | 0.12 | 105 | 0.15 | 79 | 0.13 | " |
| 111 | 525 | 0.12 | 102 | 0.14 | 81 | 0.13 | " |
| 112 | 585 | 0.11 | 100 | 0.11 | 95 | 0.11 | Invention |
| 113 | 586 | 0.12 | 101 | 0.12 | 93 | 0.12 | " |
| 114 | 590 | 0.12 | 102 | 0.12 | 95 | 0.12 | " |
| 115 | 595 | 0.12 | 101 | 0.12 | 92 | 0.12 | " |
| 116 | 631 | 0.11 | 100 | 0.11 | 98 | 0.11 | " |
| 117 | 600 | 0.11 | 102 | 0.12 | 93 | 0.11 | " |
| 118 | 610 | 0.12 | 100 | 0.12 | 95 | 0.11 | " |
| 119 | 580 | 0.11 | 102 | 0.11 | 95 | 0.11 | " |
| 120 | 110 | 0.12 | 107 | 0.15 | 46 | 0.13 | Comparison |
| 121 | 115 | 0.12 | 108 | 0.16 | 49 | 0.14 | " |
| 122 | 120 | 0.12 | 109 | 0.15 | 54 | 0.14 | " |
| 123 | 350 | 0.12 | 106 | 0.15 | 74 | 0.13 | " |
| 124 | 410 | 0.12 | 105 | 0.15 | 72 | 0.13 | " |
| 125 | 340 | 0.12 | 105 | 0.15 | 65 | 0.14 | " |
| 126 | 290 | 0.12 | 109 | 0.14 | 75 | 0.13 | " |
| 127 | 310 | 0.12 | 111 | 0.15 | 79 | 0.14 | " |
| 128 | 540 | 0.12 | 103 | 0.13 | 93 | 0.13 | Invention |
| 129 | 520 | 0.12 | 103 | 0.13 | 92 | 0.12 | " |
| 130 | 570 | 0.12 | 102 | 0.12 | 94 | 0.11 | " |
| 131 | 610 | 0.12 | 101 | 0.12 | 94 | 0.11 | " |

EXAMPLE 2

A multilayer color photographic printing paper containing a silver chlorobromide emulsion of 1 mol % in silver bromide content and 99 mol % in silver chloride content in each layer was prepared in the same manner as in Example 1, except for using the following spectral sensitizing dyes in the blue-sensitive emulsion layer and the green-sensitive emulsion layer, respectively.

Blue-Sensitive Emulsion Layer:

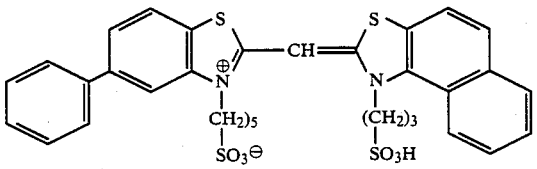

($5.0 \times 10^{-4}$ mol per mol of silver halide)

Green-Sensitive Emulsion Layer:

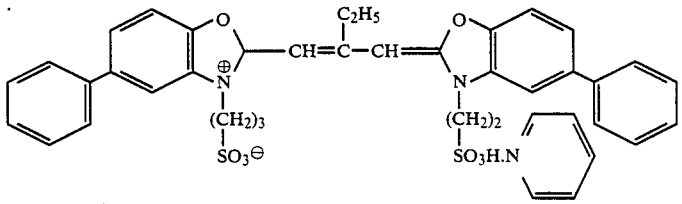

($4.0 \times 10^{-4}$ mol per mol of silver halide)

and

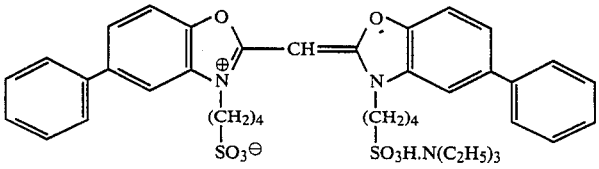

($7.0 \times 10^{-5}$ mol per mol of silver halide)

LAYER CONSTITUTION

Formulations of respective layers are shown below. Numerical values show coated amounts in terms of $g/m^2$. Numerical values for silver halide emulsions show amounts of coated silver.

SUPPORT

Polyethylene-laminated paper (containing a white pigment ($TiO_2$) and a bluing dye (ultramarine) in polyethylene on the first layer side

| | |
|---|---|
| First Layer: Blue-Sensitive Emulsion Layer | |
| Silver halide emulsion (Br: 1 mol %) | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Second Layer: Color Mixing-Preventing Layer | |
| Gelatin | 0.99 |
| Color mixing-preventing agent (Cpd-2) | 0.08 |
| Third Layer: Green-Sensitive Emulsion Layer | |
| Silver halide emulsion (Br: 1 mol %) | 0.36 |
| Gelatin | 1.24 |
| Magenta coupler (ExM-2) | 0.31 |
| Color image stabilizer (Cpd-3) | 0.25 |
| Color image stabilizer (Cpd-8) | 0.12 |
| Solvent (Solv-5) | 0.42 |
| Fourth Layer: Ultraviolet Ray-Absorbing Layer | |
| Gelatin | 1.58 |
| UV ray absorbent (UV-1) | 0.62 |
| Color mixing-preventing agent (Cpd-5) | 0.05 |
| Solvent (Solv-3) | 0.24 |
| Fifth Layer: Red-Sensitive Emulsion Layer | |
| Silver halide emulsion (Br: 1 mol %) | 0.23 |
| Gelatin | 1.34 |
| Cyan coupler (ExC-2) | 0.34 |
| Color image stabilizer (Cpd-6) | 0.17 |
| Polymer (Cpd-7) | 0.40 |
| Solvent (Solv-4) | 0.23 |
| Sixth Layer: Ultraviolet Ray-Absorbing Layer | |
| Gelatin | 0.53 |
| UV ray absorbent (UV-1) | 0.21 |
| Solvent (Solv-3) | 0.08 |
| Seventh Layer: Protective Layer | |
| Gelatin | 1.33 |
| Acryl-modified copolymer of polyvinyl alcohol (modification degree: 17%) | 0.17 |
| Liquid paraffin | 0.03 |

(ExM-2) Magenta Coupler

-continued

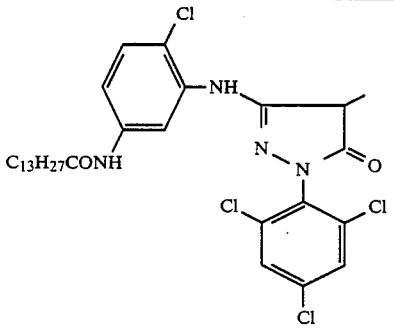

(ExC-2) Cyan Coupler

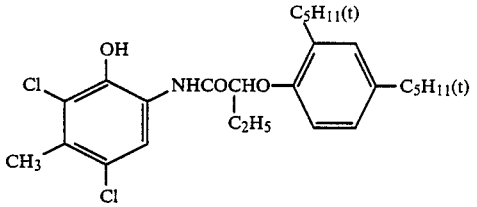

(Cpd-8) Color Image Stabilizer

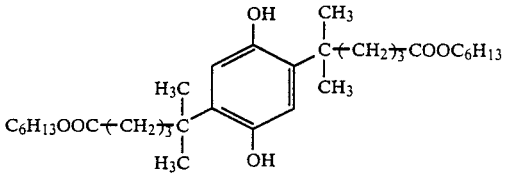

(Solv-5) Solvent

A mixture (1/1 by volume) of:

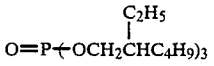

and

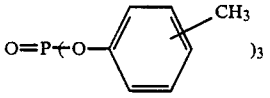

Additionally, the silver halide emulsion used for the blue-sensitive emulsion layer was a monodispersed cubic silver chlorobromide emulsion of 0.92 μm in average grain size and 0.09 in coefficient of variation, that for the green-sensitive emulsion layer was a monodispersed cubic silver chlorobromide emulsion of 0.45 μm in average grain size and 0.10 in coefficient of variation, and that for the red-sensitive emulsion layer was a monodispersed cubic silver chlorobromide emulsion of 0.48 μm in average grain size and 0.09 in coefficient of variation.

This silver halide color photographic material was referred to as Sample 201. Samples 202 to 208 as shown in Table 3 were prepared in the same manner as in Example 1.

These samples were exposed in the same manner as in Example 1, then developed according to the following processing steps.

| Processing Step | Temperature (°C.) | Time (sec) | Replenishing Amount* (ml) | Tank Volume (l) |
|---|---|---|---|---|
| Color Development | 35 | 45 | 161 | 17 |
| Bleach-Fixing | 30–36 | 45 | 161 | 17 |
| Rinsing (1) | 30–37 | 20 | — | 10 |
| Rinsing (2) | 30–37 | 20 | — | 10 |
| Rinsing (3) | 30–37 | 20 | — | 10 |
| Rinsing (4) | 30–37 | 30 | 248 | 10 |
| Drying | 70–80 | 60 | | |

*Per $m^2$ of light-sensitive material (in a four-tank countercurrent manner in the order of rinsing (4) → rinsing (1)

Formulations of respective processing solutions are as follows.

| Color Developer: | Tank Solution | Replenisher |
|---|---|---|
| Water | 800 ml | 800 ml |
| Ethylenediamine-N,N,N',N'-tetramethylenephosphonic Acid | 1.5 g | 1.5 g |
| Triethylenediamine (1,4-diazabicyclo[2,2,2]octane | 5.0 g | 5.0 g |
| Sodium Chloride | 1.4 g | — |
| Potassium Carbonate | 25 g | 25 g |
| N-Ethyl-N-β-(methanesulfonamidoethyl)-3-methyl-4-aminoaniline Sulfate | 5.0 g | 7.0 g |
| Diethylhydroxylamine | 4.2 g | 6.0 g |
| Fluorescent Brightening Agent (UVITEX CK, manufactured by Ciba Geigy) | 2.0 g | 2.5 g |
| Water to make | 1,000 ml | 1,000 ml |
| pH (25° C.) | 10.05 | 10.45 |

Bleach-Fixing Solution: (tank solution and replenisher had the same formulation)

| | |
|---|---|
| Water | 400 ml |
| Ammonium Thiosulfate (70%) | 100 ml |
| Sodium Sulfite | 17 g |
| Iron(III) Ammonium Ethylenediaminetetraacetate | 55 g |
| Disodium Ethylenediaminetetraacetate | 5 g |
| Ammonium Bromide | 40 g |
| Glacial Acetic Acid | 9 g |
| Water to make | 1,000 ml |
| pH (25° C.) | 5.40 |

Rinsing Solution: (tank solution and replenisher had the same formulation)

Deionized Water (contents of calcium and magnesium: 3 ppm or less)

The results of the same tests as in Example 1 are tabulated in Table 4.

TABLE 3

| Sample No. | Compound (I) ($0.9 \times 10^{-4}$ mol/mol of AgX) | Compound (II) ($2.6 \times 10^{-3}$ mol/mol of AgX) | Comparative Compound ($0.9 \times 10^{-4}$ mol/mol of AgX) | Remarks |
|---|---|---|---|---|
| 201 | — | — | Sensitizing Dye (1) | Comparison |
| 202 | — | — | Compound (a) | " |
| 203 | — | — | Compound (b) | " |
| 204 | (I-1) | — | — | " |
| 205 | — | (II-6) | Sensitizing Dye (1) | " |
| 206 | — | " | Compound (a) | " |
| 207 | — | " | Compound (b) | " |
| 208 | (I-1) | " | — | Invention |
| 209 | — | — | Compound (c) | Comparison |
| 210 | — | — | Compound (d) | " |
| 211 | — | — | Compound (e) | " |
| 212 | — | II-6 | Compound (k) | " |
| 213 | — | II-6 | Compound (d) | " |
| 214 | — | II-20 | Compound (e) | " |
| 215 | I-2 | — | — | " |
| 216 | I-3 | — | — | " |
| 217 | I-7 | — | — | " |
| 218 | I-8 | — | — | " |
| 219 | I-1 | — | Compound (f)* | " |
| 220 | I-2 | — | Compound (f)* | " |
| 221 | I-3 | — | Compound (f)* | " |
| 222 | I-7 | — | Compound (g)* | " |
| 223 | I-8 | — | Compound (g)* | " |
| 224 | I-1 | II-2 | — | Invention |
| 225 | I-2 | II-6 | — | " |
| 226 | I-3 | II-6 | — | " |
| 227 | I-7 | II-6 | — | " |
| 228 | I-8 | II-6 | — | Invention |
| 229 | I-1 | II-3 | — | " |
| 230 | I-1 | II-4 | — | " |
| 231 | I-1 | II-7 | — | " |
| 232 | I-1 | II-11 | — | " |
| 233 | I-1 | II-15 | — | " |
| 234 | I-1 | II-21 | — | " |
| 235 | I-1 | II-19 | — | " |
| 236 | I-1 | II-20 | — | " |

*The amount of Compound (f) and Compound (g) is $2.6 \times 10^{-3}$ mol/AgX-1 mol, respectively.

TABLE 4

| Sample No. | Sensitivity (Fr) | Fog (Fr) | Shelf Life Properties Storage-1 Sensitivity | Storage-1 Fog | Storage-2 Sensitivity | Storage-2 Fog | Remarks |
|---|---|---|---|---|---|---|---|
| 201 | 100 | 0.12 | 107 | 0.17 | 32 | 0.14 | Comparison |
| 202 | 120 | 0.12 | 105 | 0.17 | 33 | 0.14 | " |
| 203 | 125 | 0.12 | 105 | 0.18 | 36 | 0.14 | " |
| 204 | 129 | 0.12 | 102 | 0.17 | 40 | 0.13 | " |
| 205 | 380 | 0.12 | 105 | 0.16 | 63 | 0.14 | " |
| 206 | 479 | 0.12 | 105 | 0.16 | 65 | 0.13 | " |
| 207 | 501 | 0.12 | 105 | 0.15 | 79 | 0.13 | " |
| 208 | 603 | 0.11 | 102 | 0.12 | 95 | 0.11 | Invention |
| 209 | 105 | 0.12 | 110 | 0.18 | 35 | 0.15 | Comparison |
| 210 | 120 | 0.12 | 111 | 0.17 | 40 | 0.14 | " |
| 211 | 125 | 0.12 | 115 | 0.18 | 37 | 0.13 | " |
| 212 | 350 | 0.12 | 108 | 0.15 | 55 | 0.14 | " |
| 213 | 360 | 0.12 | 109 | 0.15 | 60 | 0.13 | " |
| 214 | 383 | 0.12 | 111 | 0.16 | 57 | 0.13 | " |
| 215 | 131 | 0.12 | 106 | 0.16 | 57 | 0.14 | " |
| 216 | 142 | 0.12 | 105 | 0.15 | 60 | 0.15 | " |
| 217 | 151 | 0.12 | 107 | 0.17 | 54 | 0.13 | " |
| 218 | 120 | 0.12 | 106 | 0.17 | 60 | 0.17 | " |
| 219 | 390 | 0.12 | 105 | 0.15 | 65 | 0.14 | " |
| 220 | 250 | 0.12 | 107 | 0.16 | 60 | 0.16 | " |
| 221 | 200 | 0.12 | 108 | 0.17 | 62 | 0.14 | " |
| 222 | 235 | 0.12 | 107 | 0.18 | 64 | 0.17 | " |
| 223 | 400 | 0.12 | 105 | 0.15 | 67 | 0.14 | " |
| 224 | 710 | 0.11 | 102 | 0.11 | 96 | 0.11 | Invention |
| 225 | 640 | 0.10 | 102 | 0.12 | 97 | 0.12 | " |
| 226 | 660 | 0.10 | 101 | 0.11 | 96 | 0.11 | " |
| 227 | 630 | 0.10 | 101 | 0.11 | 99 | 0.10 | " |
| 228 | 720 | 0.11 | 100 | 0.12 | 96 | 0.11 | Invention |
| 229 | 710 | 0.10 | 102 | 0.11 | 100 | 0.11 | " |
| 230 | 645 | 0.11 | 101 | 0.11 | 99 | 0.12 | " |
| 231 | 590 | 0.10 | 102 | 0.11 | 96 | 0.11 | " |
| 232 | 712 | 0.11 | 101 | 0.12 | 97 | 0.12 | " |
| 233 | 590 | 0.11 | 102 | 0.13 | 94 | 0.13 | " |
| 234 | 530 | 0.11 | 104 | 0.14 | 90 | 0.14 | " |
| 235 | 560 | 0.11 | 103 | 0.14 | 93 | 0.13 | " |
| 236 | 565 | 0.11 | 103 | 0.13 | 92 | 0.14 | " |

As is apparent from the results of Tables 2 and 4, the samples of the present invention using a compound represented by formula (I) and a compound represented by formula (II) in combination extremely were superior to the comparative samples using a compound represented by formula (I) or a compound represented by formula (II) independently, with respect to sensitivity and shelf life properties; even if a compound represented by formula (II) was used for the samples, the samples using Compounds (a) to (e) (sensitizing dyes) which are not the compounds represented by formula (I) of the present invention were inferior to the samples using the compounds of formulae (I) and (II) of the present invention in combination, with respect to the above effect; among a cross-linking type pentamethinecyanine dye, the effect of oxa-thiapentamethinecyanine of the present invention was extremely superior to the effect of thia-thiapentamethinecyanine such as Compounds (b) to (e) (sensitizing dyes); and particularly, the sensitizing dyes such as Compounds (I-1), (I-2), (I-3), (I-4), (I-7) and (I-8) in which $V_1$ and $V_2$, and $V_3$ and $V_4$ form benzene rings had high sensitivity as compared with the sensitizing dyes such as Compounds (I-21), (I-22), (I-23) and (I-24).

Further, as is apparent from the results of Tables 2 and 4, among the compounds represented by formula (II), the compounds represented by formulae (II-a) and (II-b) gave high sensitivity and excellent shelf life properties, particularly the compounds represented by formula (II-b) exhibited the most excellent effect, and further compounds in which D of formula (II) contained sulfonic acid groups were superior to Compounds (II-21) and (II-22) in which D did not contain sulfonic acid groups, with respect to sensitivity and shelf life properties and particularly compounds in which D was stilbene was the most superior.

Furthermore, as is apparent from the results of Tables 2 and 4, although Compounds (f) and (g) were compounds which were added to a protective layer as a hardening agent in U.S. Pat. No. 4,618,570, the Compounds (f) and (g) were added to the same layer as a layer in which the sensitizing dyes was added according to the present invention since sensitizing ability would not be obtained by the addition to a separate layer and as a result the shelf life properties due to Compounds (f) and (g) were poor and the sensitizing ability was extremely poor.

It is apparent from the results of Table 4 that the samples with the silver chlorobromide emulsion containing 1 mol % of silver bromide and 99 mol % of silver chloride of the present invention also showed high sensitivity, less fog, and excellent shelf life properties.

As is apparent from the results shown in Tables 2 and 4, the silver halide color photographic materials of the present invention have a high sensitivity and undergo less change in sensitivity and less increase in fog when stored at elevated temperatures and/or under high humidity.

EXAMPLE 3

A multilayer color photographic printing paper was prepared by the same manner as in Example 2, except that a composition of the third layer is as follows.

| Third Layer: Green-Sensitive Emulsion Layer | |
|---|---|
| Silver halide emulsion (Br: 1 mol %) (silver chlorobromide) | 0.16 |
| Gelatin | 1.80 |
| Magenta coupler ExM-1) | 0.35 |
| Color image stabilizer (Cpd-3) | 0.20 |
| Solvent (Solv-5) | 0.60 |

The thus-obtained samples were tested by the same manner as in Example 2.

As a result, the samples of Example 3 also could obtain the same results as in Example 2. That is, it was clearly seen that the samples of the present invention using a compound represented by the formula (I) and a compound represented by the formula (II) have high sensitivity, less fog, and excellent shelf life properties.

EXAMPLE 4

A multilayer color photographic printing paper was prepared by the same manner as in Examples 1, 2 and 3, respectively, except that 1,2-bis(vinylsulfonyl)ethane was used as a gelatin hardener in each layer in Examples 1, 2, and 3, respectively.

The thus-obtained samples were tested by the same manner as Example corresponding to each sample.

As a result, it was confirmed that the samples of the present invention using a compound represented by the formula (I) and a compound represented by the formula (II) have high sensitivity, less fog, and excellent shelf life properties.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon at least one silver halide emulsion layer, wherein said at least one silver halide emulsion layer comprises at least one compound represented by the formula (I) and at least one compound represented by the formula (II):

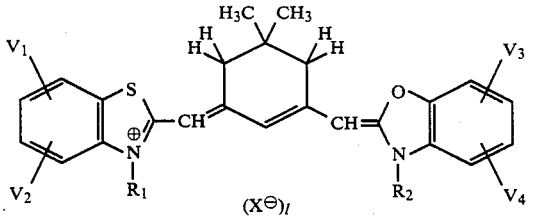

(I)

wherein $V_1$, $V_2$, $V_3$ and $V_4$ each represents a hydrogen atom, a halogen atom, an alkyl group, an acyl group, an acyloxy group, an alkoxycarbonyl group, a carbamoyl group, a sulfamoyl group, a carboxy group, a cyano group, a hydroxy group, an amino group, an acylamino group, an alkoxy group or an aryl group, or $V_1$ and $V_2$, or $V_3$ and $V_4$ may be bound to each other to form a benzene ring;

$R_1$ and $R_2$, which may be the same or different, each represents an alkyl group and may optionally form a salt with a metal atom or other organic compound;

$X^{\ominus}$ represents an anion; and l represents 0 or 1 or, when the dye forms an inner salt, l represents 0;

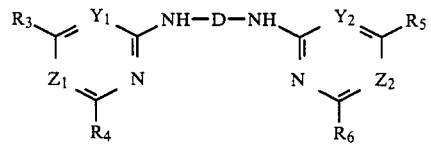

(II)

wherein

D represents a divalent aromatic moiety;

$R_3$, $R_4$, $R_5$ and $R_6$ each represents a hydrogen atom, a hydroxy group, an alkoxy group, or an aryloxy group, a heterocyclic group, a mercapto group, an alkylthio group, an arylthio group, a heterocyclylthio group, an amino group, an alkylamino gorup, a cyclohexylamino group, an arylamino group, a heterocyclylamino group, an aralkylamino group or an aryl group;

$Y_1$ and $Y_2$ each represents —N= or —CH=; and $Z_1$ and $Z_2$ each represents —N= or —CH=;

further at least one of $Y_1$ and $Z_1$ is —N=, and at least one of $Y_2$ and $Z_2$ is —N=.

2. A silver halide color photographic material as claimed in claim 1, wherein one or both of said $V_1$ and $V_2$ and said $V_3$ and $V_4$ in the formula (I) forms a benzene ring.

3. A silver halide color photographic material as claimed in claim 1, wherein D in the formula (II) is represented by the following formulae $D_1$ or $D_2$:

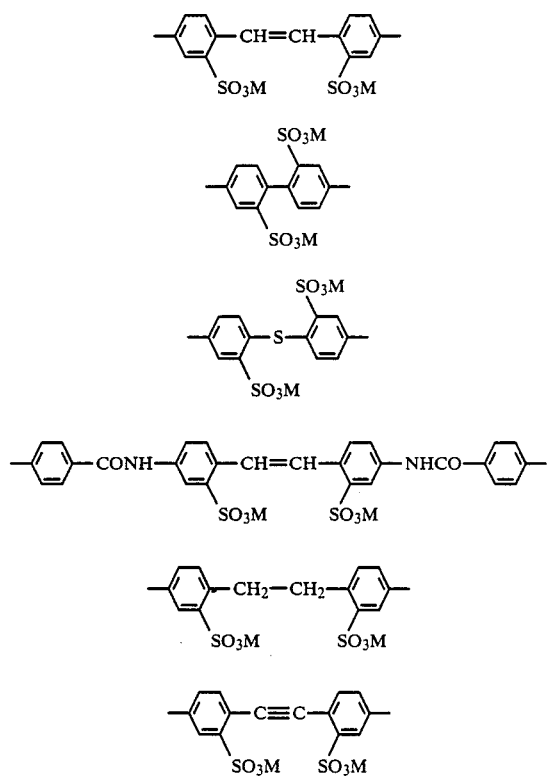

wherein M represents a hydrogen atom or a cation capable of giving water solubility;

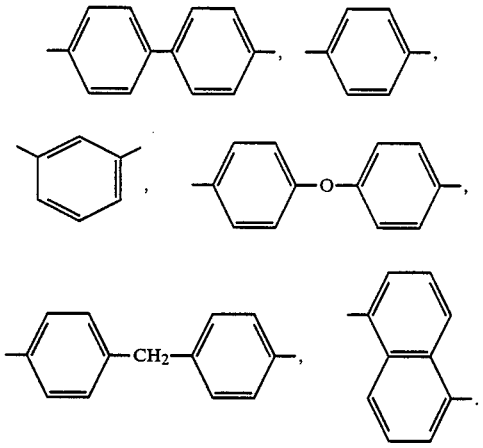

4. A silver halide color photographic material as claimed in claim 1, wherein an amount of the added compound represented by the formula (I) is from $1\times10^{-6}$ to $1\times10^{-3}$ mol per mol of silver halide, an amount of the added compound represented by the formula (II) is from $1\times10^{-6}$ to $1\times10^{-1}$ mol per mol of silver halide, and a molar ratio of the compound represented by the formula (I) to the compound represented by the formula (II) is from 1/100 to 10/1.

5. A silver halide color photographic material as claimed in claim 1, wherein said at least one compound rerpesented by the formula (II) is at least one compound represented by the formula (II-a):

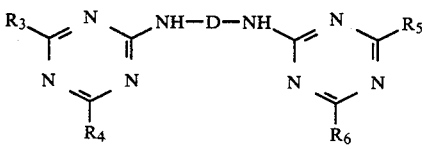

(II-a)

wherein

D represents a divalent aromatic moiety;

$R_3$, $R_4$, $R_5$ and $R_6$ each represents a hydrogen atom, a hydroxy group, an alkoxy group, an aryloxy group, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group.

6. A silver halide color photographic material as claimed in claim 1, wherein said at least one compound represented by the formula (II) is at least one compound represented by the formula (II-b):

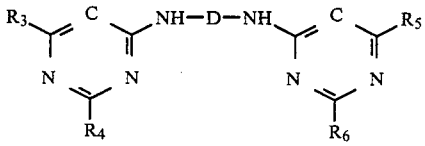

(II-b)

wherein

D represents a divalent aromatic moiety;

$R_3$, $R_4$, $R_5$ and $R_6$ each represents a hydrogen atom, a hydroxy group, and alkoxy group, and aryloxy group, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group.

7. A silver halide color photographic material as claimed in claim 1, wherein said D contains a sulfonic acid group or a sulfonic acid salt.

8. A silver halide color photographic material as claimed in claim 3, wherein when said D represents $D_2$, at least one of $R_3$, $R_4$, $R_5$ and $R_6$ is a substituent having $-SO_3M$.

9. A silver halide color photographic material as claimed in claim 3, wherein said D is the formula $D_1$.

10. A silver halide color photographic material as claimed in claim 3, wherein said D is the formula

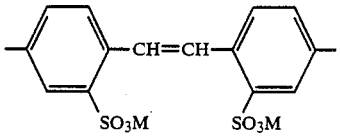

11. A silver halide color photographic material as claimed in claim 1, wherein said at least one compound represented by the formula (II) is at least one compound selected from compounds II-2, II-3, II-4, II-6, II-7 and II-11:

(II-2): Disodium 4,4'-bis[2,6-di(benzothiazolyl-2-amino) pyrimidine-4-ylamino]stilbene-2,2'-disulfonate (II-3): Disodium 4,4'-bis[2,6-di(1-phenyltetrazolyl-5-thio) pyrimidine-4-ylamino]stilbene-2,2'-disulfonate (II-4): Disodium 4,4'-bis[2,6-di(benzimidazolyl-2-thio)-pyrimidine-4-ylamino]stilbene-2,2'-disulfonate (II-6): Disodium 4,4'-bis[2,6-di(naphthyl-2-oxy)-pyrimidine-4-ylamino]stilbene-2,2'-disulfonate (II-7): Disodium 4,4'-bis[2,6-di(naphthyl-2-oxy)-pyrimidine-4-ylamino]bibenzyl-2,2'-disulfonate (II-11): Disodium 4,4'-bis[2,6-dianilinopyrimidine-4-ylamino]stilbene-2,2'-disulfonate.

* * * * *